US008678366B2

(12) United States Patent
Bowers

(10) Patent No.: US 8,678,366 B2
(45) Date of Patent: Mar. 25, 2014

(54) PORTABLE CRADLE DEVICE

(76) Inventor: Jason Bowers, South Windsor, CT (US)

( * ) Notice: Subject to any disclaimer, the term of this patent is extended or adjusted under 35 U.S.C. 154(b) by 210 days.

(21) Appl. No.: 12/862,302

(22) Filed: Aug. 24, 2010

(65) Prior Publication Data

US 2011/0049780 A1 Mar. 3, 2011

Related U.S. Application Data

(60) Provisional application No. 61/275,422, filed on Aug. 28, 2009.

(51) Int. Cl.
*B25H 1/10* (2006.01)
*B25H 1/04* (2006.01)
*B25H 1/08* (2006.01)

(52) U.S. Cl.
USPC ..... 269/289 R; 269/309; 269/902

(58) Field of Classification Search
USPC ..... 83/761; 279/2.21, 2.11, 2.02; 269/902, 269/900, 310, 309, 302.1, 296, 295, 289 R; 220/735, 694; 144/287, 286.5; 108/25, 108/147.19
See application file for complete search history.

(56) References Cited

U.S. PATENT DOCUMENTS

| | | | | | |
|---|---|---|---|---|---|
| 323,229 | A * | 7/1885 | Storbridge et al. | 83/448 |
| 2,024,112 | A * | 12/1935 | Phillis | 269/87.2 |
| 2,108,992 | A * | 2/1938 | Obenshain | 83/762 |
| 3,516,571 | A * | 6/1970 | Roper et al. | 220/792 |
| 3,866,897 | A * | 2/1975 | Whalen, Jr. | 269/87.2 |
| 3,935,779 | A * | 2/1976 | Hildebrandt et al. | 83/762 |
| 4,807,862 | A * | 2/1989 | Popeil et al. | 269/87.2 |
| 4,945,648 | A * | 8/1990 | Roth et al. | 33/529 |
| 5,546,852 | A * | 8/1996 | Bidwell | 99/446 |
| 5,556,181 | A * | 9/1996 | Bertrand | 312/313 |
| 5,718,158 | A * | 2/1998 | Rogge | 83/762 |
| D406,035 | S * | 2/1999 | Erisoty et al. | D8/71 |
| 5,927,701 | A * | 7/1999 | Chapman | 269/87.2 |
| 6,152,435 | A * | 11/2000 | Snell | 269/43 |
| 6,360,797 | B1 * | 3/2002 | Brazell et al. | 144/286.1 |
| 6,435,497 | B1 * | 8/2002 | Borter | 269/296 |
| 6,668,695 | B2 * | 12/2003 | Poole et al. | 83/466 |
| 6,843,183 | B2 * | 1/2005 | Strong | 108/147.21 |
| 2002/0017752 | A1 * | 2/2002 | Levi | 269/139 |
| 2007/0029215 | A1 * | 2/2007 | Martinez et al. | 206/223 |
| 2010/0006011 | A1 * | 1/2010 | Cruz | 108/60 |

FOREIGN PATENT DOCUMENTS

AU 2004100109 A4 * 3/2004

* cited by examiner

*Primary Examiner* — Lee D Wilson
*Assistant Examiner* — Tyrone V Hall, Jr.
(74) *Attorney, Agent, or Firm* — Steven M. McHugh

(57) ABSTRACT

A portable cradle device is provided and includes a cradle top section and a cradle bottom section, wherein the cradle top section includes a top portion base structure having a first component support structure and a second component support structure, and the cradle bottom section includes a cradle support structure extending downward from the cradle top portion, wherein a portion of the cradle top section is sized relative to the cradle bottom section to form a cradle lip such that when the portable cradle device is associated with a utility bucket, the cradle lip rests on the edge of the utility bucket cavity.

15 Claims, 30 Drawing Sheets

PORTABLE CRADLE DEVICE

CROSS REFERENCE TO RELATED APPLICATIONS

This application claims the benefit of U.S. Provisional Patent Application No. 61/275,422, filed Aug. 28, 2009 and entitled "Cradle Device" the contents of which are incorporated herein by reference in its entirety.

FIELD OF THE INVENTION

This invention relates generally to a device for aiding in the resizing of construction materials and more particularly to a device for cradling and stabilizing construction materials while they are being resized or reconfigured.

BACKGROUND OF THE INVENTION

During the construction, repair and remodeling of buildings and other structures it is common for workers to have to modify and customize the construction materials used. For example, when pipes are being installed in a structure, more often than not they have to be sized in length for a particular area. This is accomplished by cutting the pipe to a desired length using various types of saws depending on the type of pipe. For example, plastic pipe may be cut using various types of saws, such as band saws, chop saws, miter saws and/or hand saws. Although band saws, chop saws and miter saws make reasonably even cuts, they are not very portable and require a power supply and a level steady surface which is large enough to accommodate the size of the band saw. Hand saws, on the other hand, are more portable than band saws, chop saws and miter saws, but do not provide a means for holding the pipe steady and level during the cutting process. Properly supporting the pipe during the cutting process is important because an unsteady pipe may result in the pipe being damaged or having a cut that is not square with the axis of the pipe.

One way this can be accomplished is by securely positioning the pipe within a vice during the cutting process. However, this is undesirable for several reasons. First, the vice must be mounted on a secure and steady platform that is big enough and strong enough to support the vice. This typically requires a platform that is not portable and is thus stationary, requiring the worker to go back and forth from the work site to the vice every time a cut is required. Second, as a vice is used for many different things, the clamping surface on the vice is not typically adapted to interface and securely engage with a pipe. Accordingly, as pressure is applied to the pipe by the cutting tool the pipe tends to move and shift out of place during the cutting process. This may result in the pipe being damaged, having a cut that is not square with the axis of the pipe or worse, the worker's hand being injured by the cutting tool.

SUMMARY OF THE INVENTION

A portable cradle device is provided and includes a cradle top section and a cradle bottom section, wherein the cradle top section includes a top portion base structure having a first component support structure and a second component support structure, where the first component support structure and the second component support structure are separated by a component support valley, and the cradle bottom section includes a cradle support structure extending downward from the cradle top portion, wherein the cradle support structure is sized and shaped to fit within the cavity of a utility bucket, and wherein the cradle support structure and the top portion base structure are sized relative to each other such that the top portion base structure extends over the cradle support structure to form a lip such that when the portable cradle device is associated with a utility bucket, the cradle support structure is located within the cavity of the utility bucket and the top portion base structure lip rests on the edge of the utility bucket cavity.

A portable cradle device is provided and includes a cradle top section and a cradle bottom section, wherein the cradle top section includes a top portion base structure having a first component support structure and a second component support structure, and the cradle bottom section includes a cradle support structure extending downward from the cradle top portion, wherein a portion of the cradle top section is sized relative to the cradle bottom section to form a cradle lip such that when the portable cradle device is associated with a utility bucket, the cradle lip rests on the edge of the utility bucket cavity.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

As disclosed herein with regards to an exemplary embodiment, an easy to use, portable cradle is provided, wherein the cradle may be implemented as a standalone unit or with a utility bucket (such as a 5 gallon open top pale). When used as a standalone unit, the portable cradle may be positioned on a stable platform, such as a work bench or a table top. When used with a utility bucket, the portable cradle is snugly associated with the open top portion of the utility bucket such that the utility bucket/cradle combination is a stable platform for supporting and holding articles in place during the cutting of the article. Accordingly, when the portable cradle is being used to cut an article (with a utility bucket or standalone), the person cutting the article presses down on the article during the cutting process to help secure the article in the cradle. This results in greater safety and a smoother cut by preventing the article from moving during the cutting process.

Figure 1:
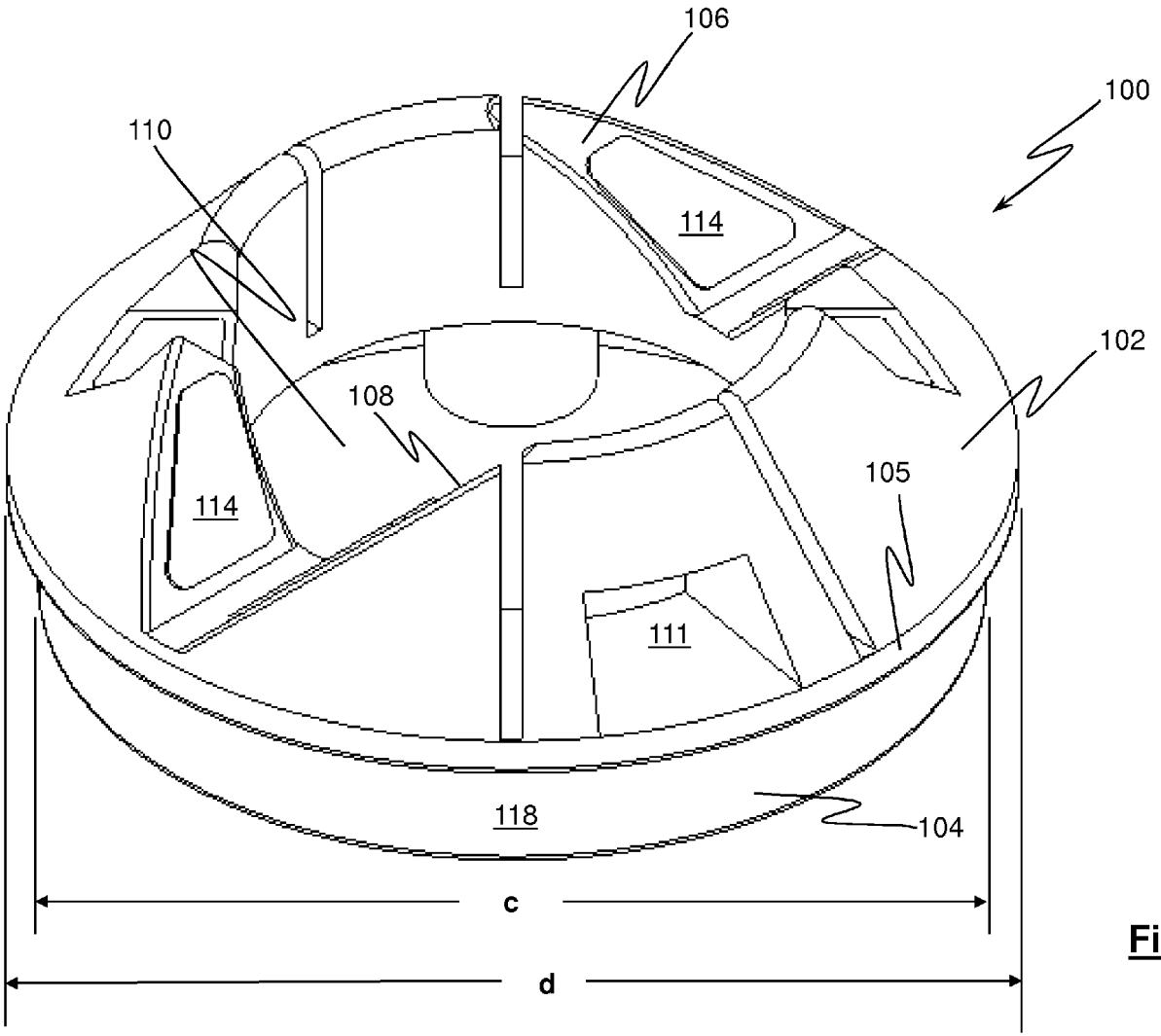
FIG. 1 is an isometric perspective view of a portable cradle device in accordance with one embodiment of the present invention.
Figure 2:
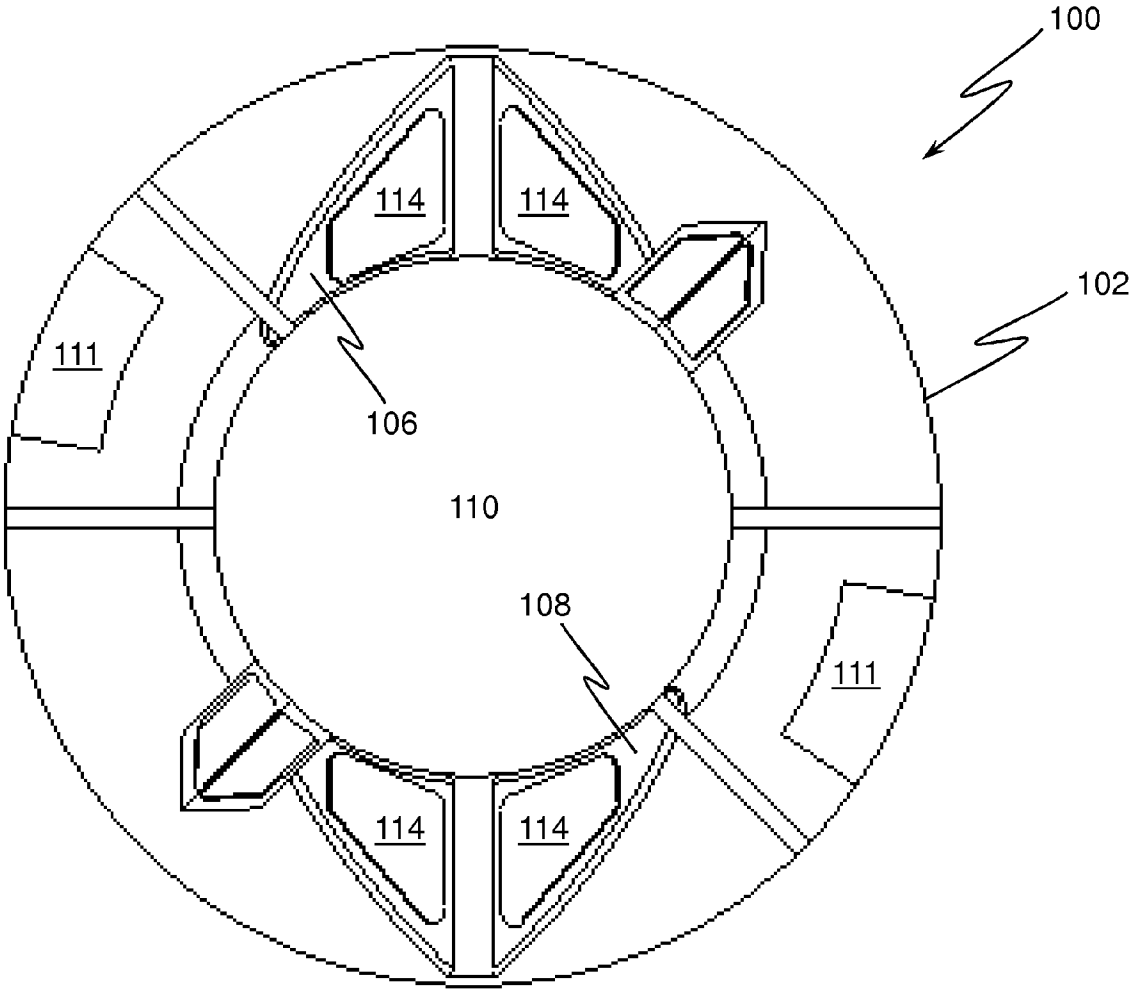
FIG. 2 is a top down view of the portable cradle device of FIG. 1.
Figure 3:
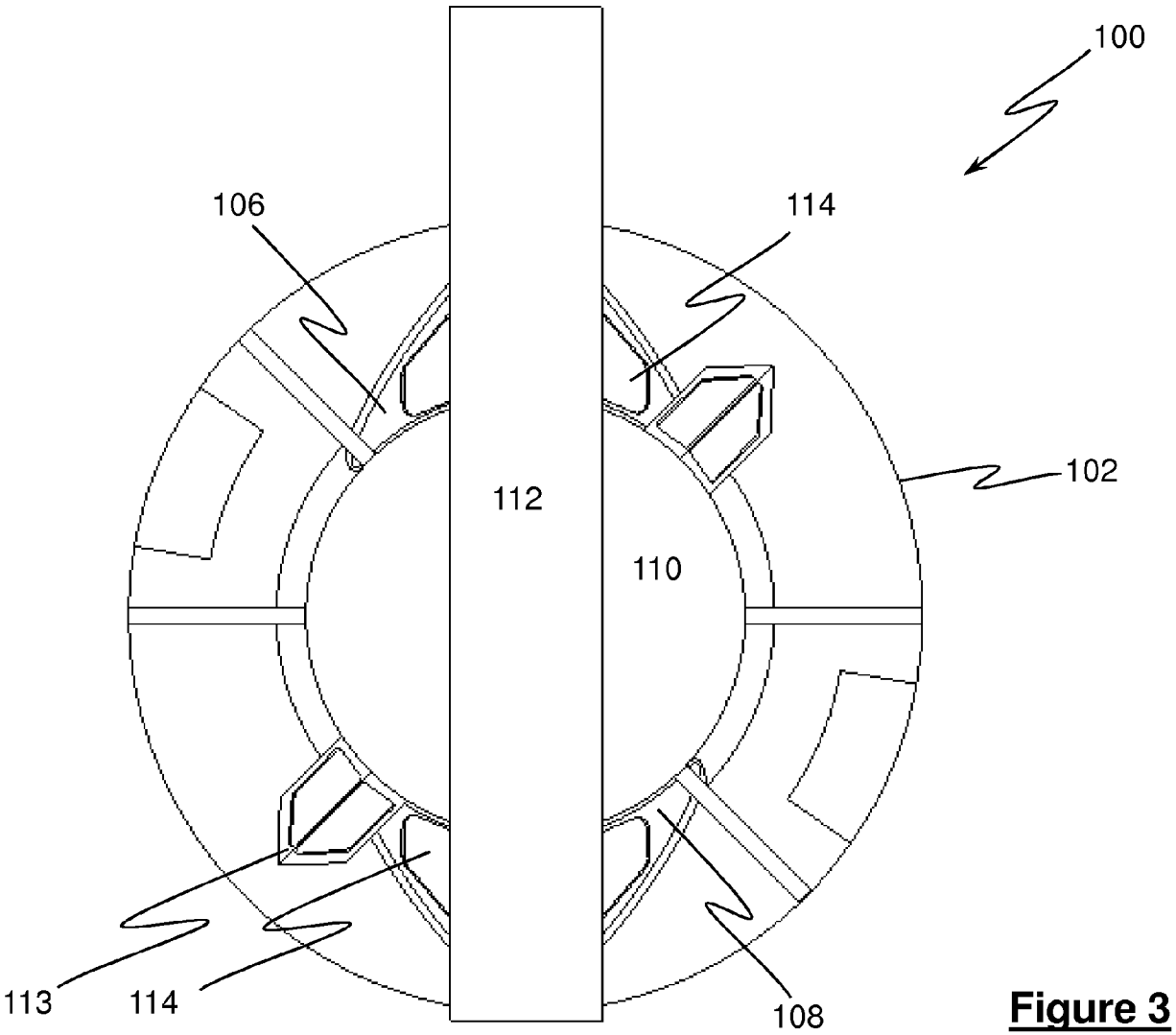
FIG. 3 is a top down view of the portable cradle device of FIG. 1 with an article being cradled in the valley.
Figure 4:
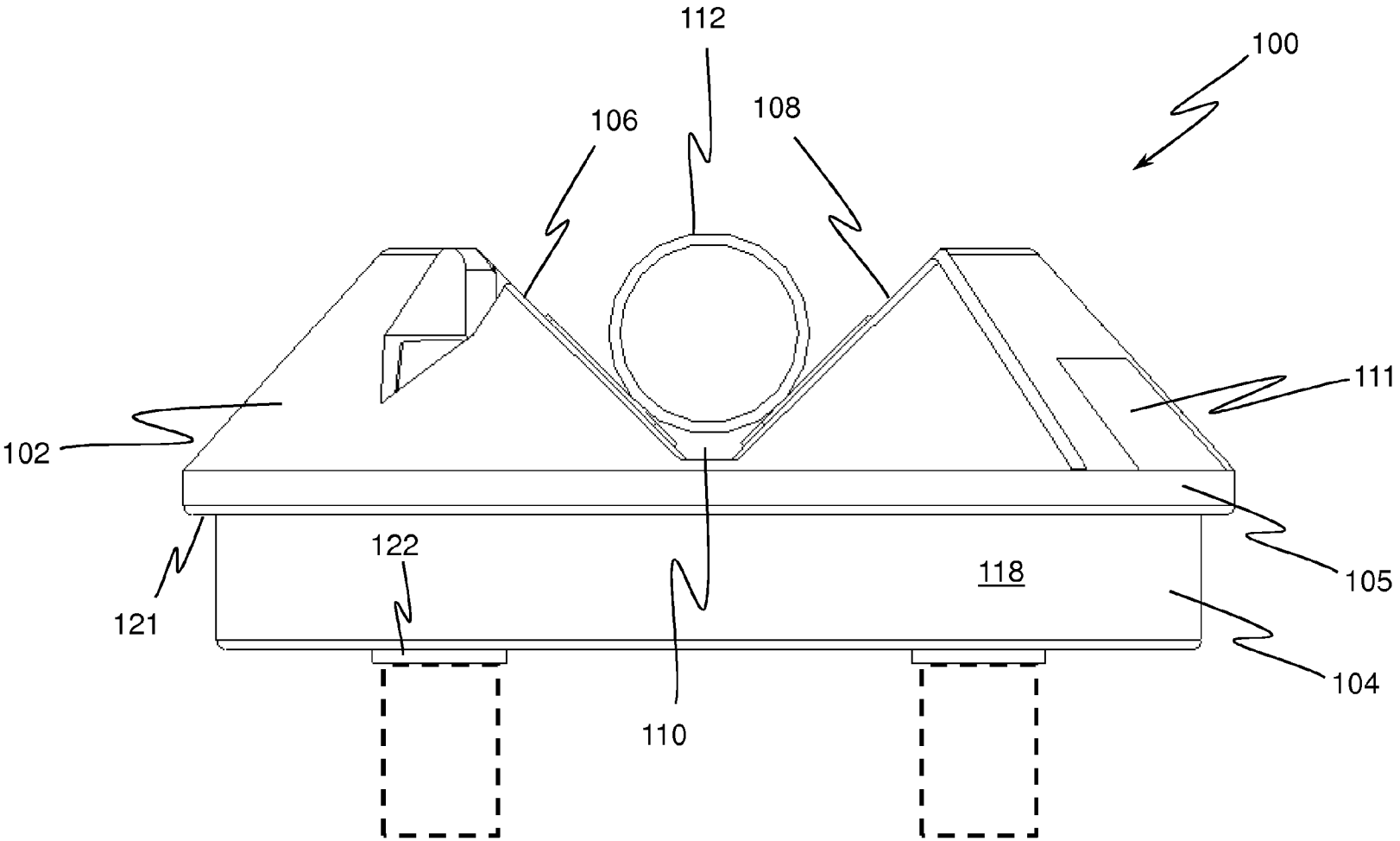
FIG. 4 is a side view of the portable cradle device of FIG. 1 with an article being cradled in the valley.
Figure 5:
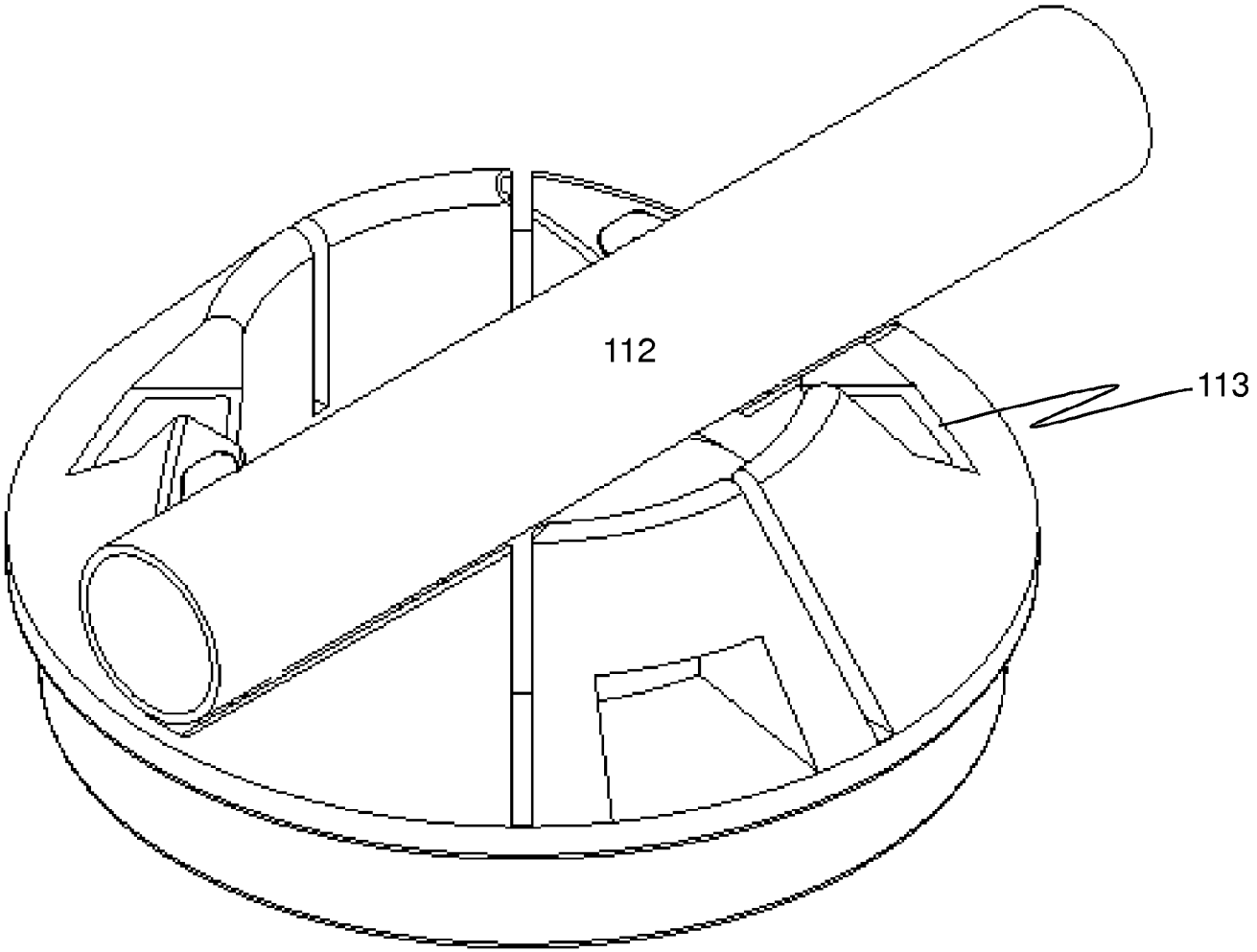
FIG. 5 is an isometric perspective view of the portable cradle device of FIG. 1 with an article being cradled in the valley.
Figure 6:
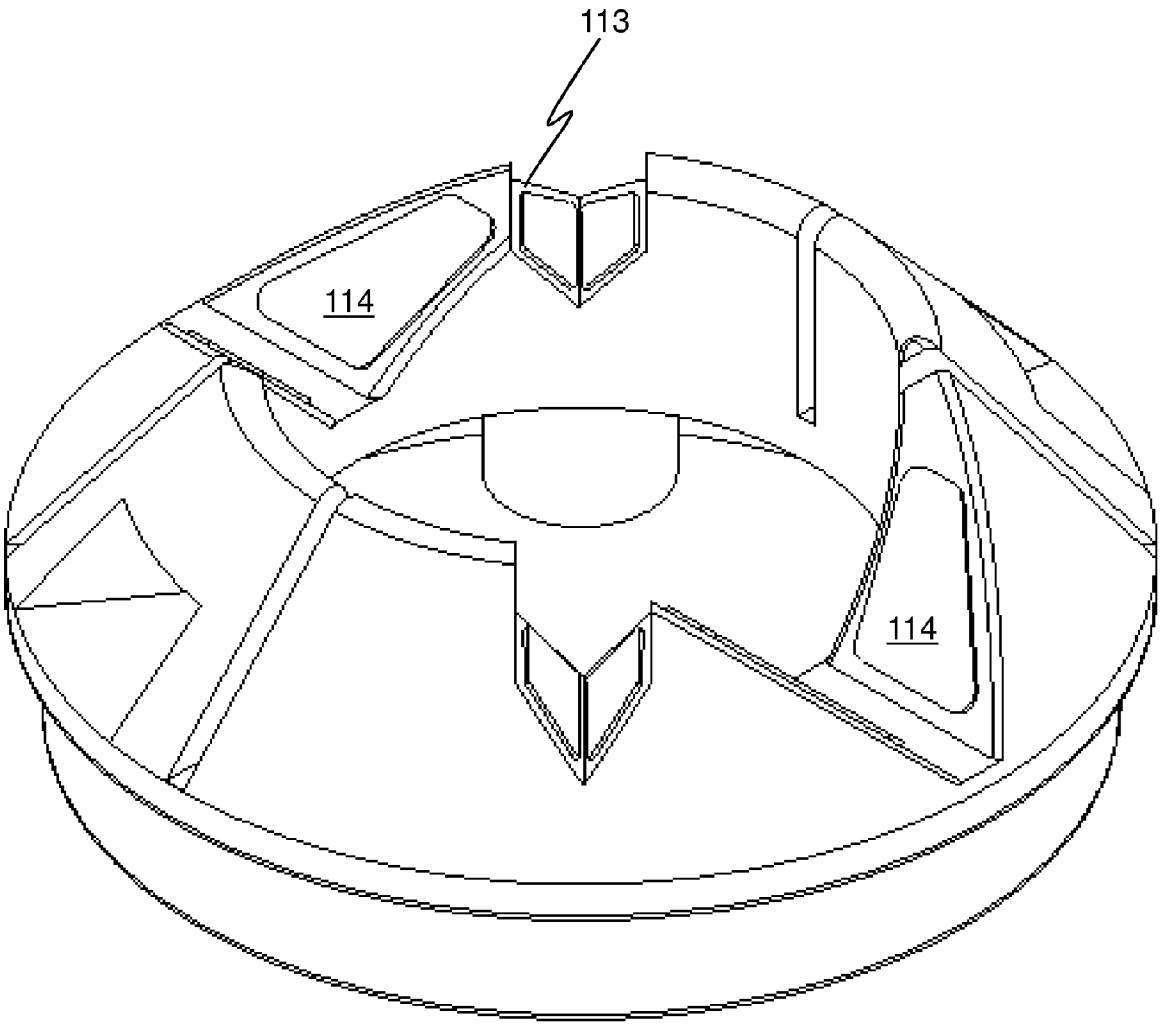
FIG. 6 is an isometric perspective view of the portable cradle device of FIG. 1, showing the smaller sized cradle section for cradling a smaller sized article.
Figure 7:
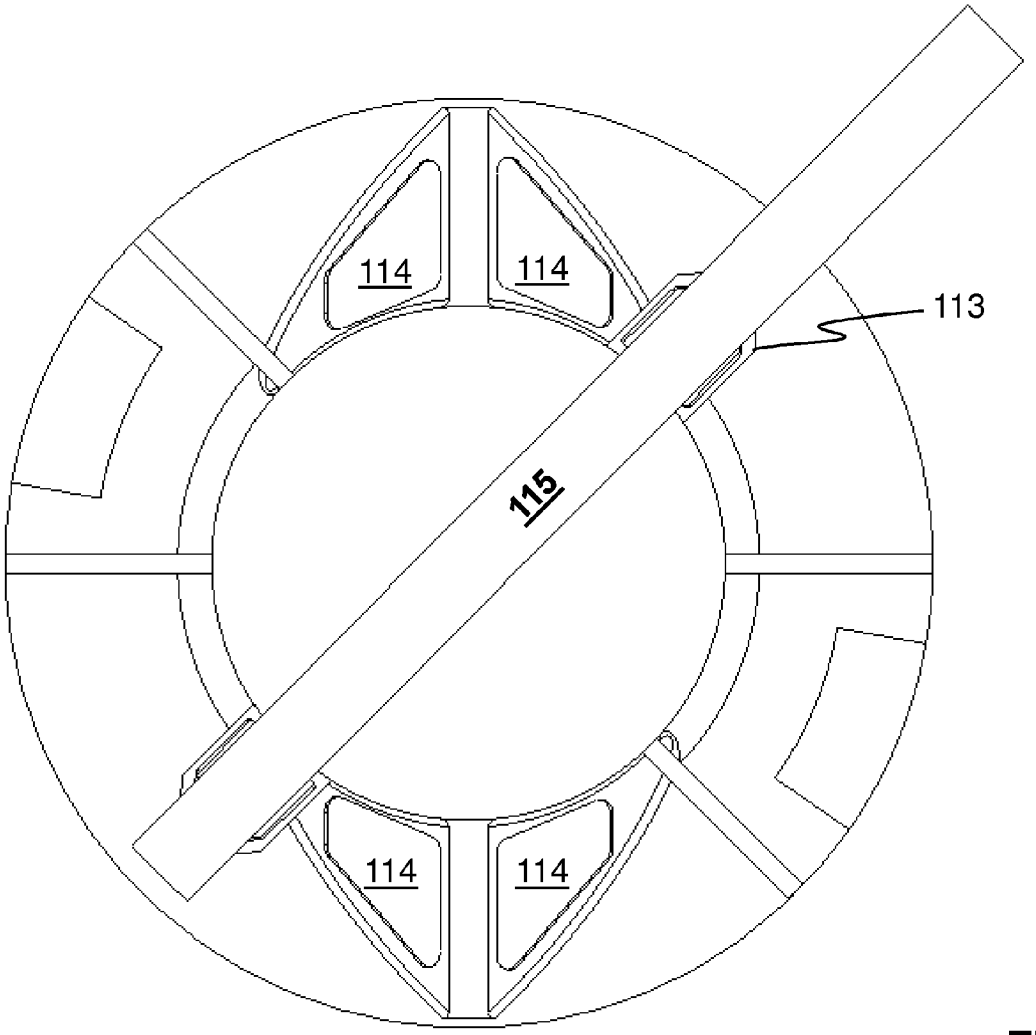
FIG. 7 is a top down view of the portable cradle device of FIG. 1, showing a smaller sized article being cradled in the smaller sized cradle section.
Figure 8:
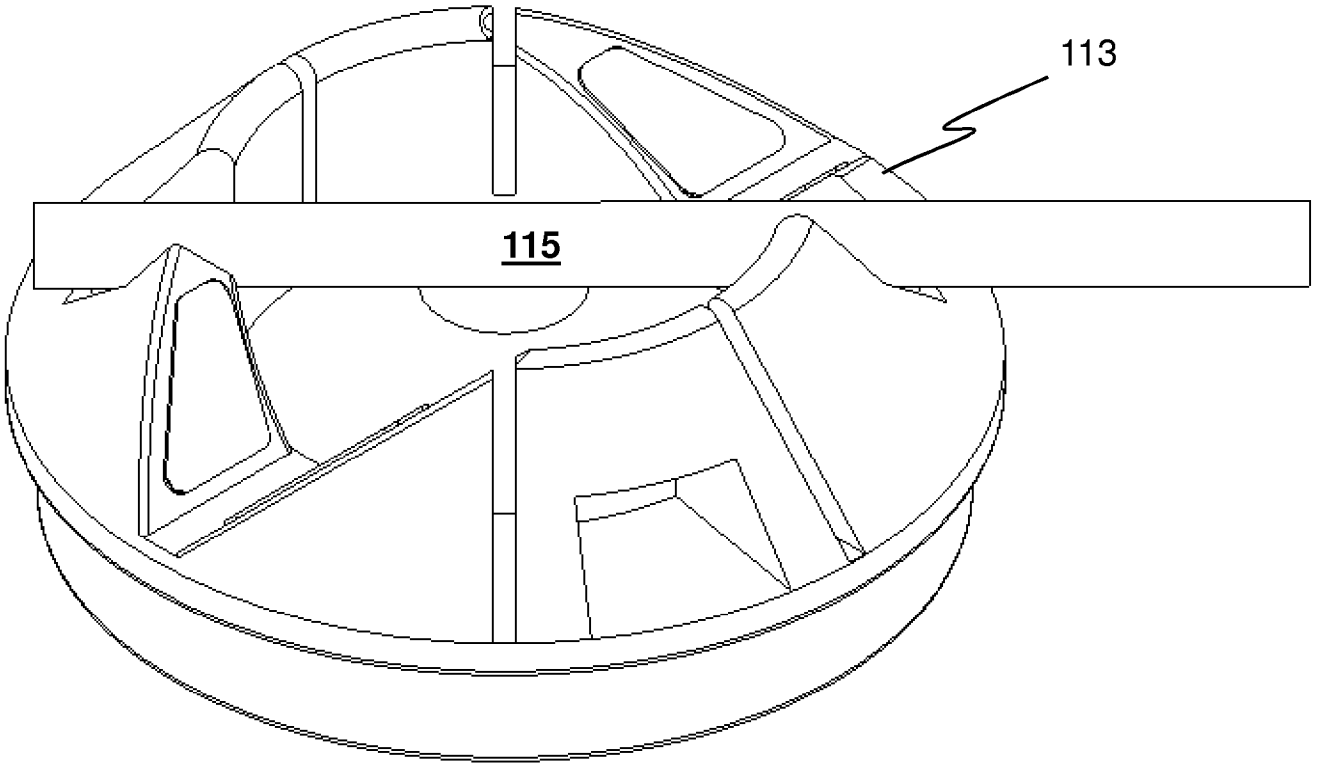
FIG. 8 is an isometric perspective view of the portable cradle device of FIG. 1, showing a smaller sized article being cradled in the smaller sized cradle section
Figure 9:
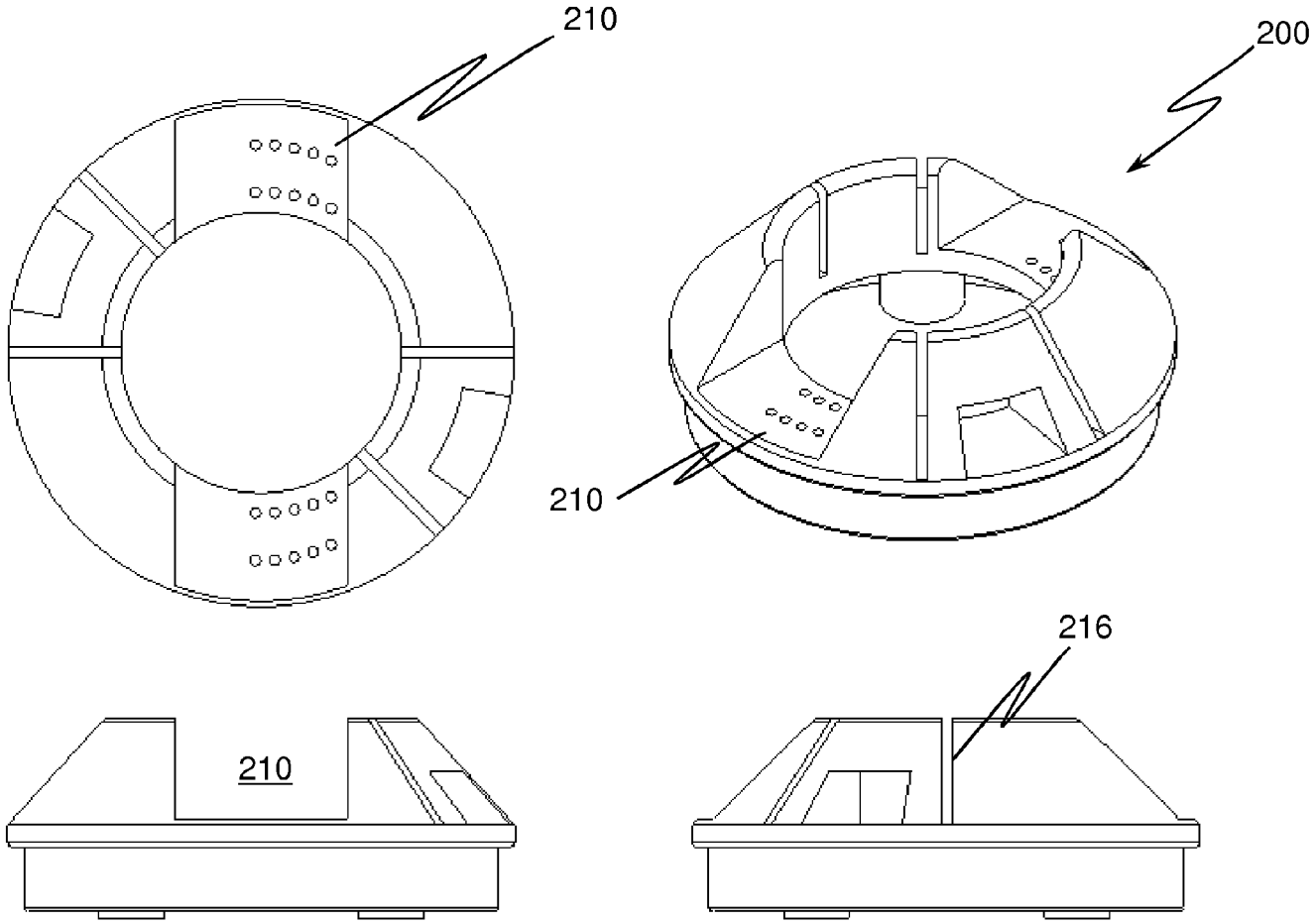
FIG. 9 is a plurality of views of an additional embodiment of the portable cradle device.
Figure 10:
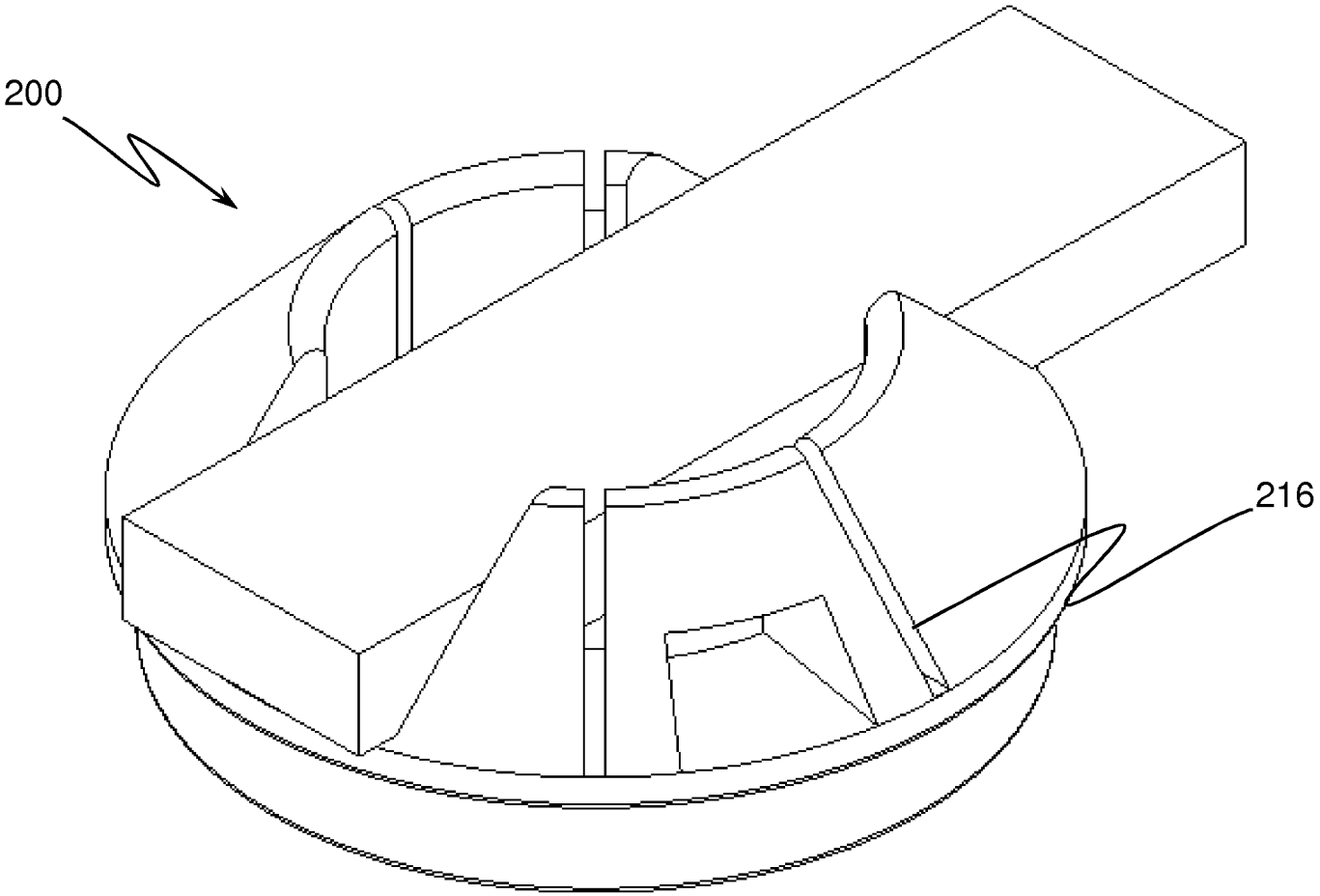
FIG. 10 is an isometric perspective view of the portable cradle device of FIG. 9 with an article being cradled in the valley of the device.

Referring to FIG. 1 and FIG. 2, one embodiment of a portable cradle device 100 is shown and includes a cradle top section 102 and a cradle bottom section 104. Cradle top portion 102 includes a top portion base structure 105 having a diameter d, a first component support structure 106 and a second component support structure 108, where the first component support structure 106 and the second component support structure 108 are separated by a component support valley 110 for supporting and containing a component to be cradled. Cradle bottom section 104 of portable cradle device 100, includes a cradle support structure 118 extending downward from the cradle top portion 102, where the cradle support structure 118 may be cylindrical in shape and may include a diameter c. It should be appreciated that the cradle bottom section 104, the cradle support structure 118 and/or the top portion base structure 105 may be any shape suitable to the desired end purpose, such as round, square, rectangle, or triangle, such that when being used with a utility bucket, a portion of the top portion base structure 105 rests on a portion of the lip of the utility bucket. It is also contemplated that when being used as a standalone unit (i.e. separate from the utility bucket), the portable cradle device 100 provides a stable platform. Referring to FIG. 3, when a component 112, such as a pipe, is being supported, the pipe 112 is positioned in the valley 110 to be resting upon first component support structure 106 and second component support structure 108 as shown in FIG. 3, FIG. 4 and FIG. 5. It should be appreciated that although first component support structure 106 and second component support structure 108 are shown as being angled from the vertical such that valley 110 is substantially V-Shaped, first component support structure 106, second component support structure 108 and/or valley 110 may be any shape suitable to the desired end purpose, such as rectangular or rounded. It is contemplated that portable cradle device 100 may also include a smaller sized and/or shaped second component support valley 113 which would allow for the cradling and/or cutting of smaller sized components 115, as shown in FIG. 6, FIG. 7 and FIG. 8. This second component support valley 113 may also be shaped as desired, such as V-shaped, rectangular shaped, etc.

Referring again to FIG. 1 and FIG. 2, first component support structure 106 and second component support structure 108 may include a traction structure 114, such as a traction pad or surface, configured to limit or prevent a component 112 from any unwanted movement (rotationally or along the axis of the component) while being cut or reconfigured. Additionally, the component 112 may be any type of component (e.g. pipe, boards, rebar, etc.) and may be of any shape (such as rectangular, triangular, etc.). The cradle top section 102 may also include at least one handle portion 111 to easily carry, hold and remove the portable cradle device 100 from a container (i.e. bucket, box, etc.).

Figure 11:
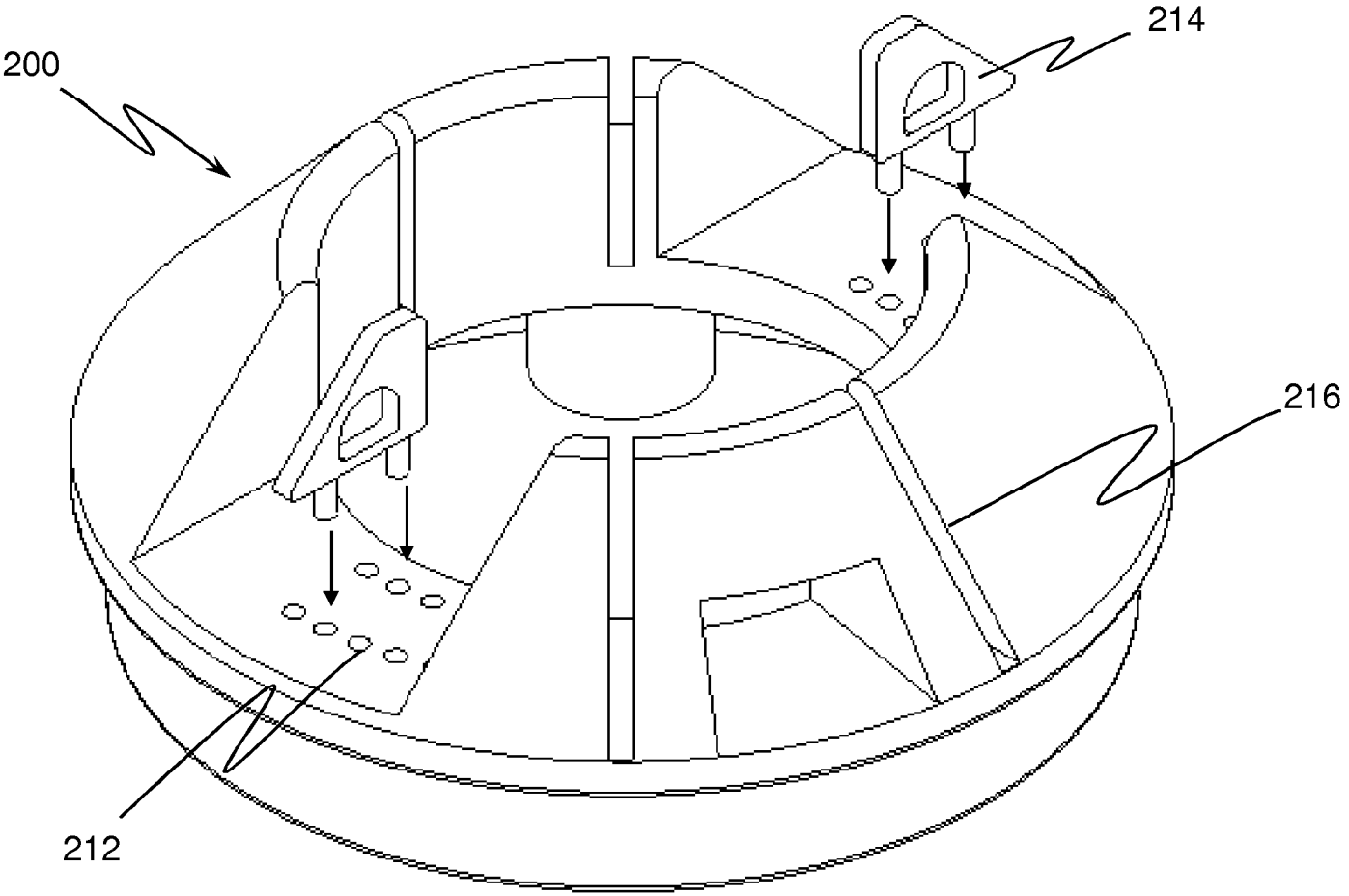
FIG. 11 is an isometric perspective view of the portable cradle device of FIG. 9 with valley resizing devices being associated with the cradle device.
Figure 12:
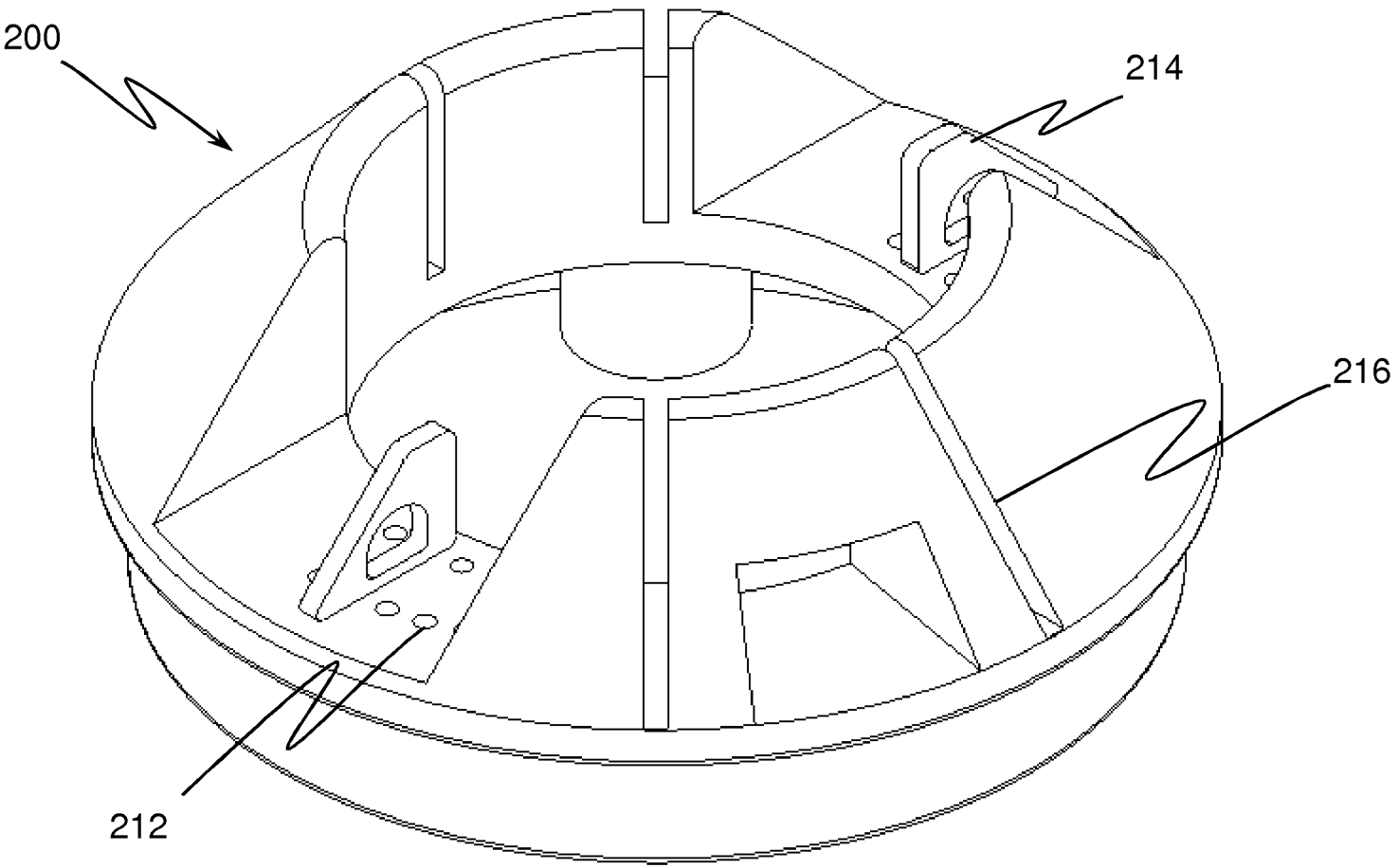
FIG. 12 is an isometric perspective view of the portable cradle device of FIG. 9 with valley resizing devices associated with the cradle device.
Figure 13:
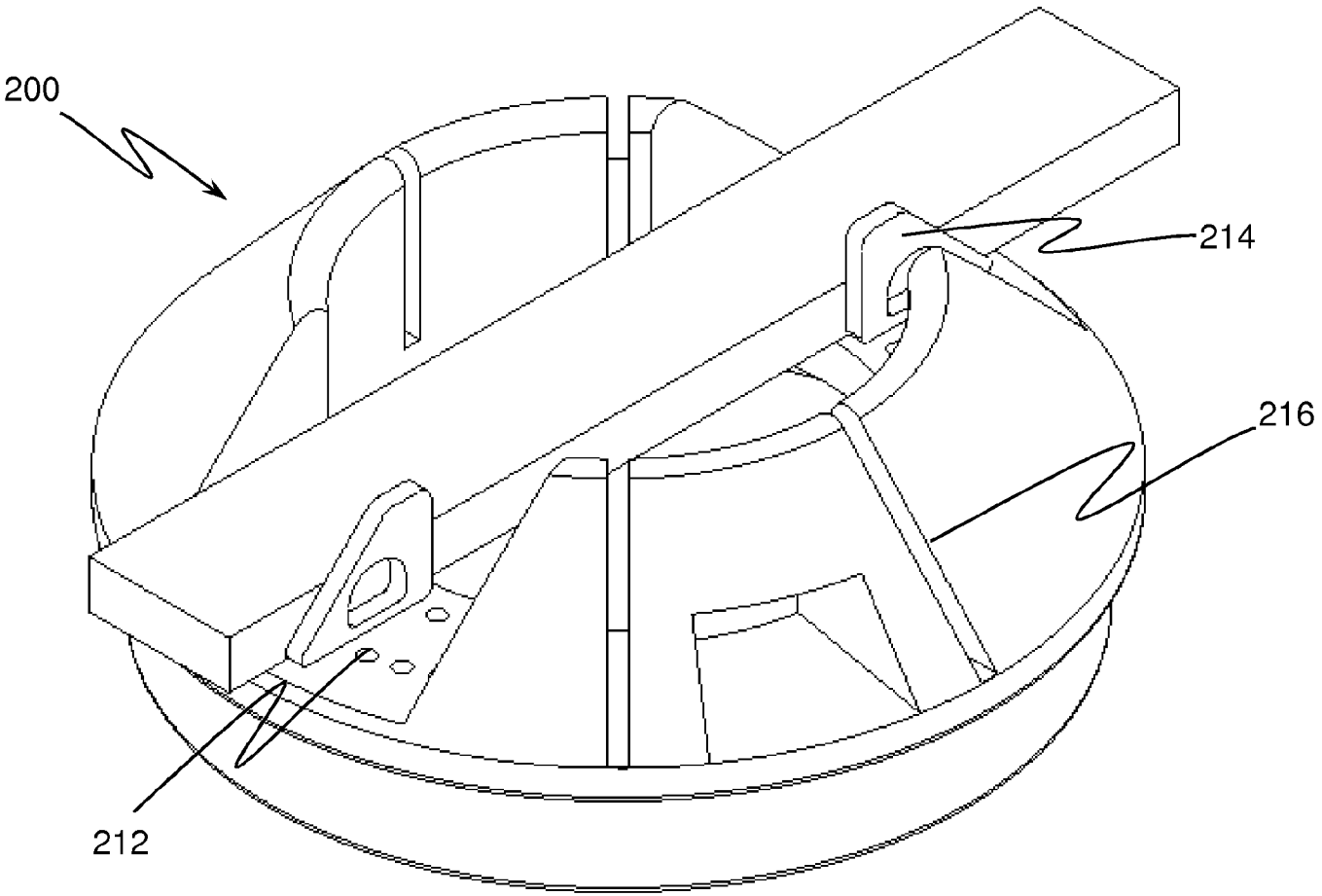
FIG. 13 is an isometric perspective view of the portable cradle device of FIG. 9 with valley resizing devices associated with the cradle device and with a rectangular shaped article being cradled.
Figure 14:
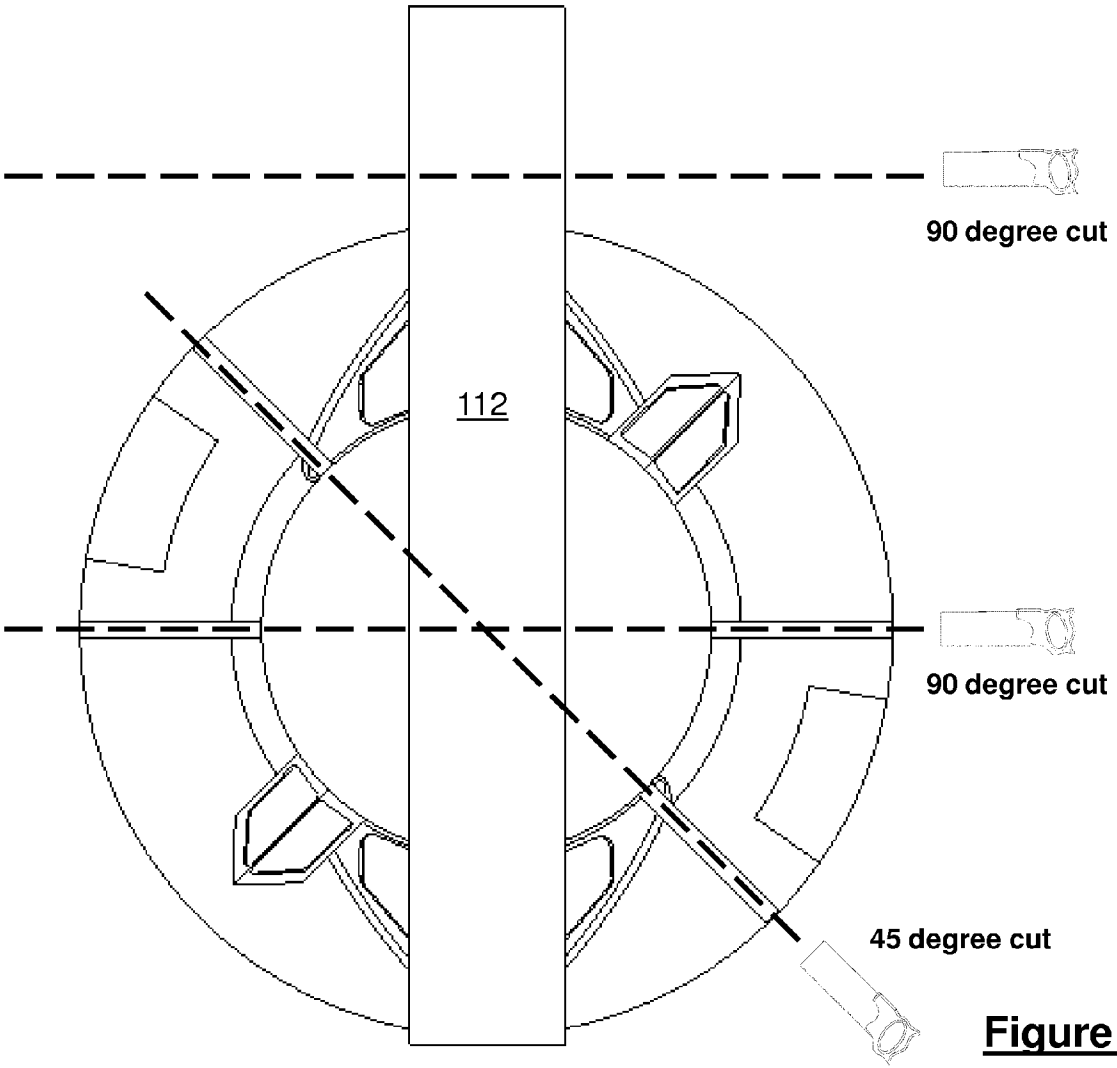
FIG. 14 is a top down view of the portable cradle device of FIG. 1 with an article cradled within the cradle device showing angles of cuts associated with the saw guide.
Figure 15:
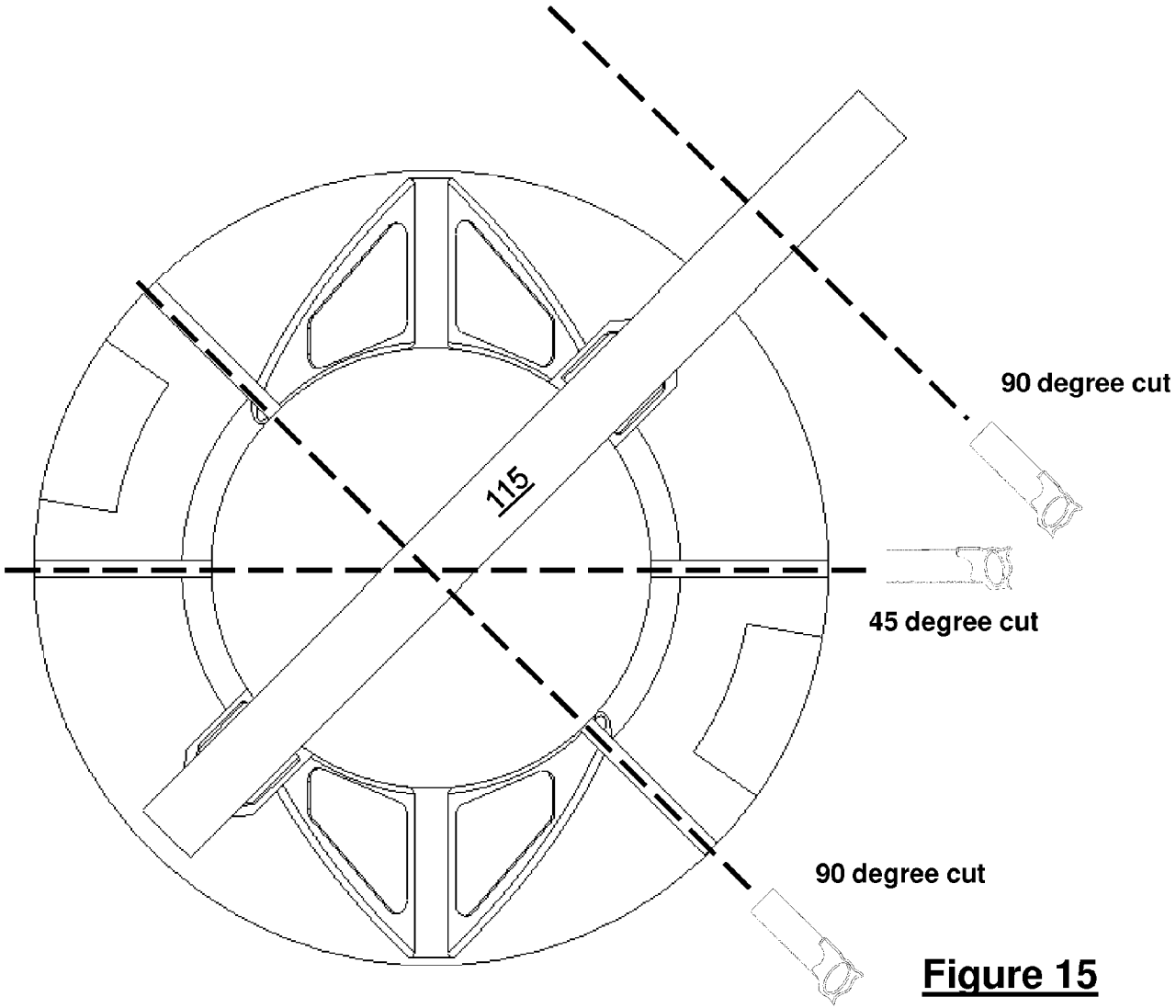
FIG. 15 is a top down view of the portable cradle device of FIG. 1 with an article cradled within the cradle device showing angles of cuts associated with the saw guide.
Figure 16:
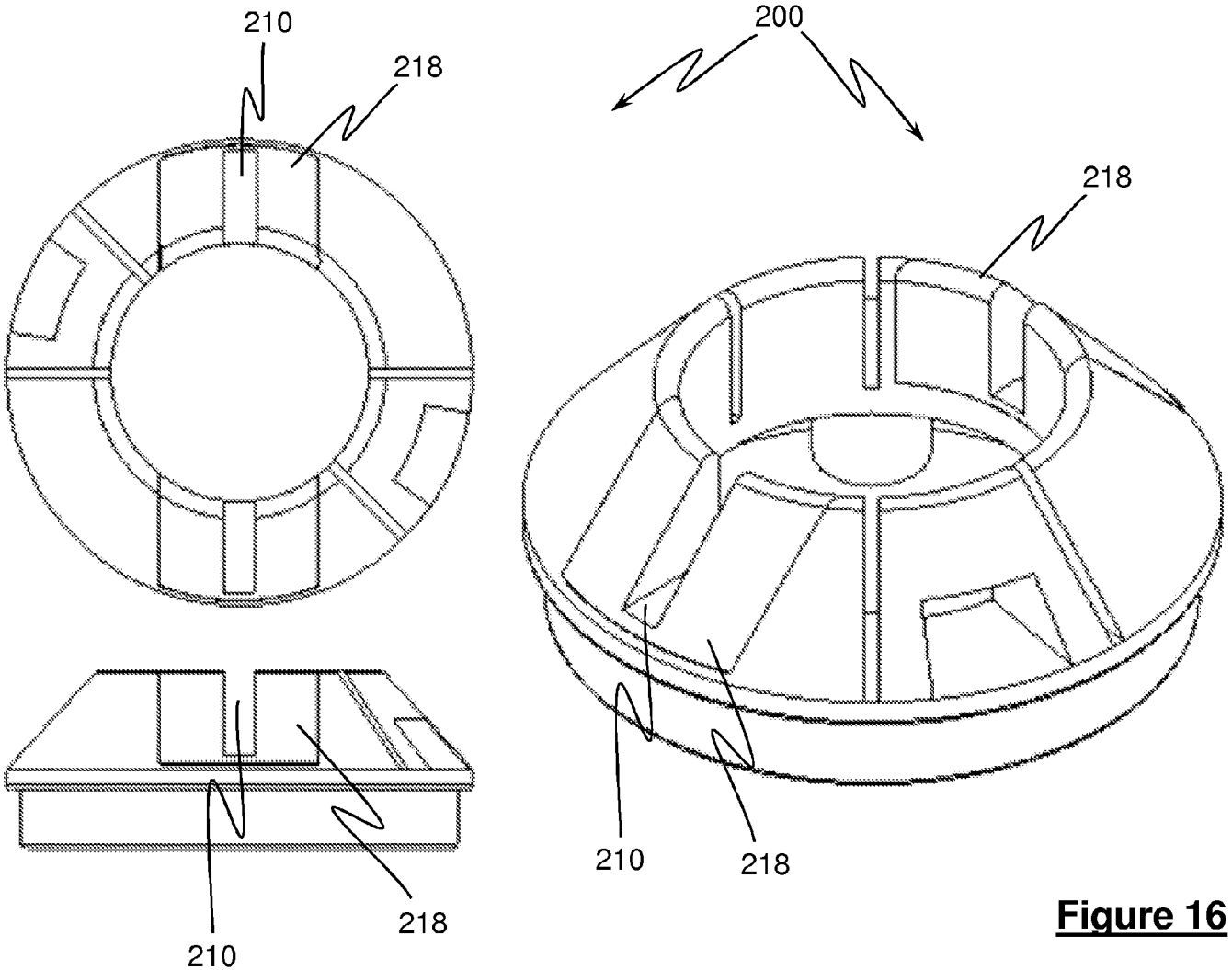
FIG. 16 shows a plurality of views of the portable cradle device of FIG. 9 using another embodiment of the valley insert to resize the valley.

Referring to FIGS. 9-13, another embodiment of the portable cradle device 200 is shown and is configured to include valleys 210 that are rectangular or square in shape to function with different types and shapes of materials, such as rectangular or square, to allow variously shaped materials to be cut. It is contemplated that valleys 210 may include at least one insert hole 212 (may include a plurality of insert holes 212) each configured to receive a protruding member of valley resizing devices 214 (one embodiment is shown in FIG. 11) to allow different sized articles to be cut using the portable cradle device 200. Additionally, portable cradle device 100, 200, 500 may include saw guides 216 to help guide a saw blade at predetermined angles relative to the article when the article is positioned in the valley 110, 210. These angles may include any angles desired, such as 45° and 90° angles, as shown in FIG. 14 and FIG. 15, or the angle of the saw guides 216 may be configurable (about any angle between 0° and 90° angles) as desired via a positionable and adjustable slide configuration which would allow the saw guides 216 to rotate about the top portion 102 to achieve a desired angle between the component 112, 115 and the saw guide 216. Additionally, it is contemplated that the saw guides 216 may be configurable to accommodate various sized saw blade widths. Referring to FIG. 16 a valley insert 218 for resizing and/or reshaping the size of valley 110, 210 to accommodate larger or smaller components 112, 115 is also contemplated. Moreover, although top portion base structure 105 is shown as being circular in shape, top portion base structure 105 may be any shape as desired suitable to the desired end purpose, such as rectangular, triangular, square, etc, and may be sized to prevent the portable cradle device 100, 200, 500 from falling into the utility bucket when the portable cradle device 100, 200, 500 is being used with the utility bucket (or other open ended object or container).

Figure 17:
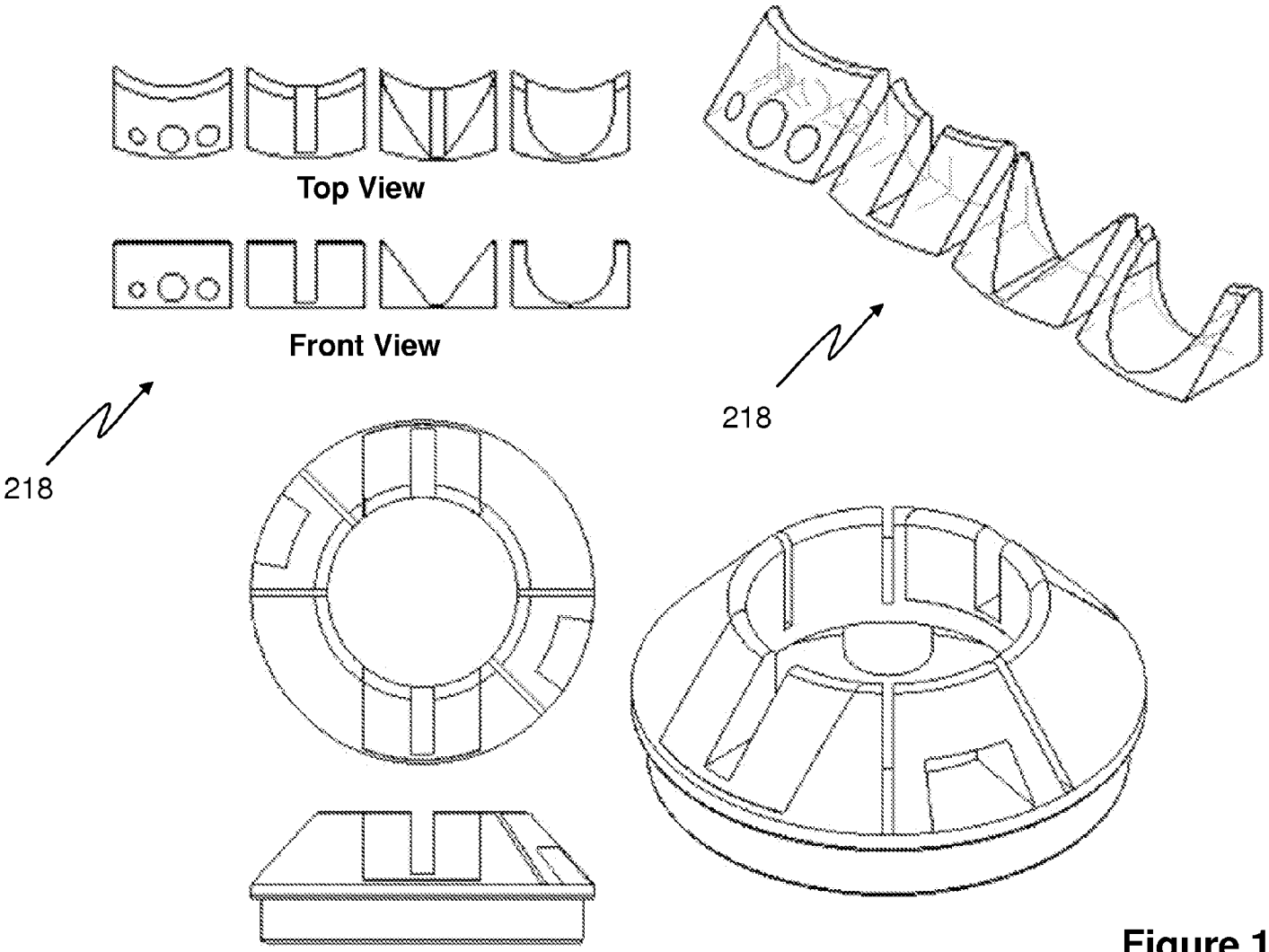
FIG. 17 shows a plurality of configurations of the valley inserts for use with the portable cradle device of FIG. 1 and FIG. 9.

It should be appreciated that valley resizing devices 214 and/or valley insert 218 may be used for all of the embodiments disclosed and encompassed herein and may be configured for different sizes and different shapes. For example, FIG. 17 shows some different shaped and sized valley inserts 218 that may be used with the second embodiment 200.

Figure 18:
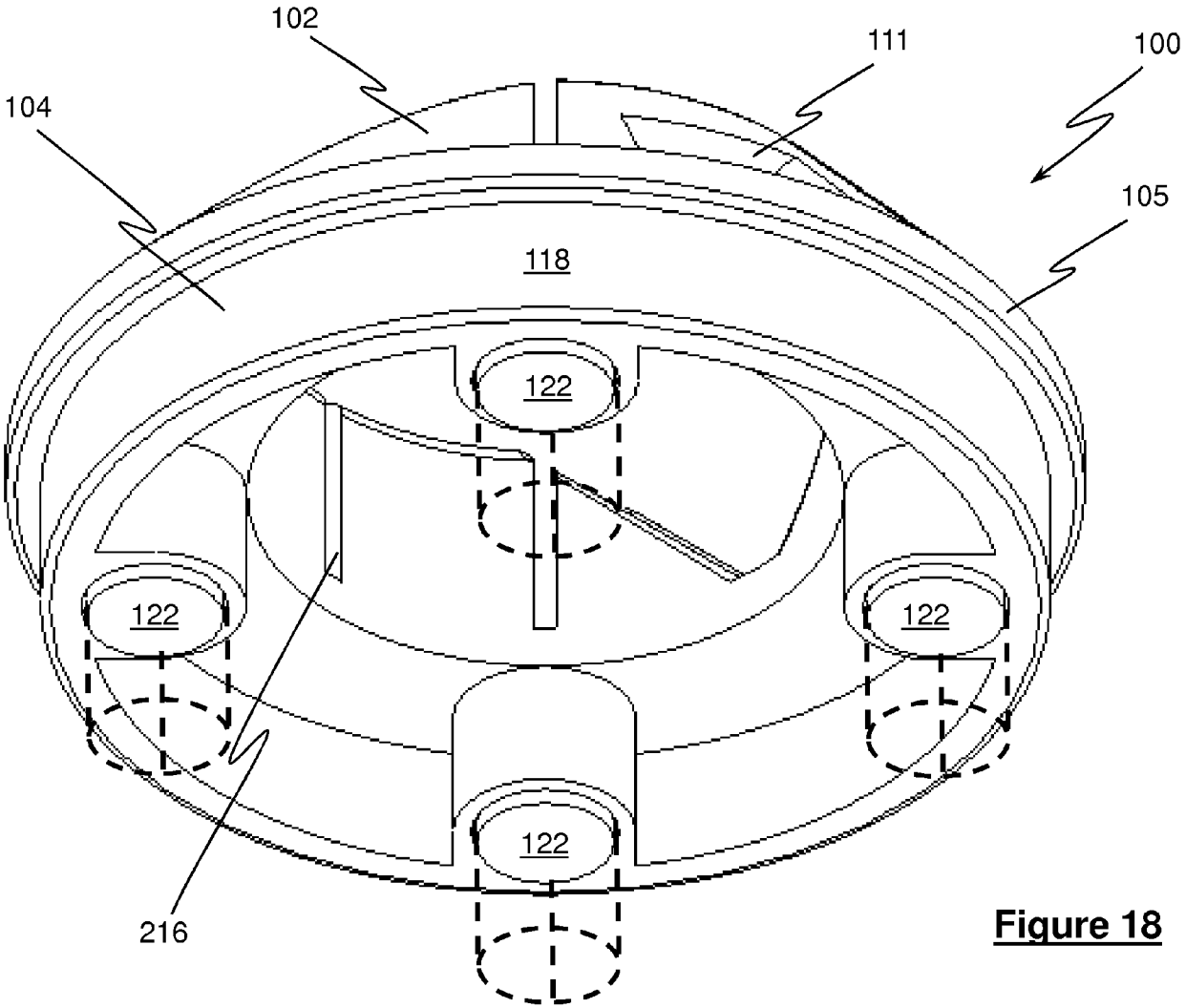
FIG. 18 is an isometric bottom view of the portable cradle device of FIG. 1, FIG. 9 and FIG. 24A.
Figure 19:
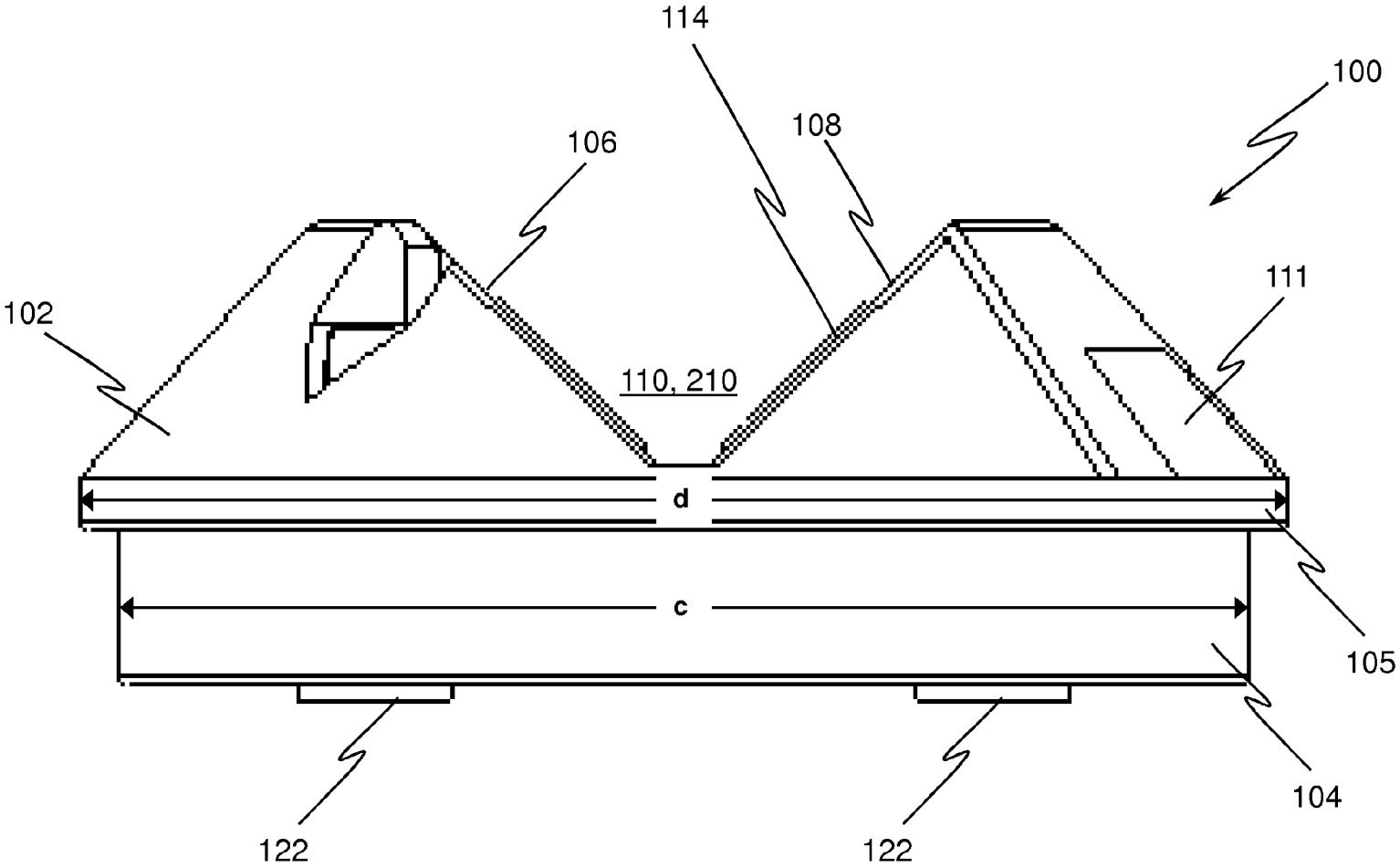
FIG. 19 is a side view of the portable cradle device of FIG. 1.
Figure 20:
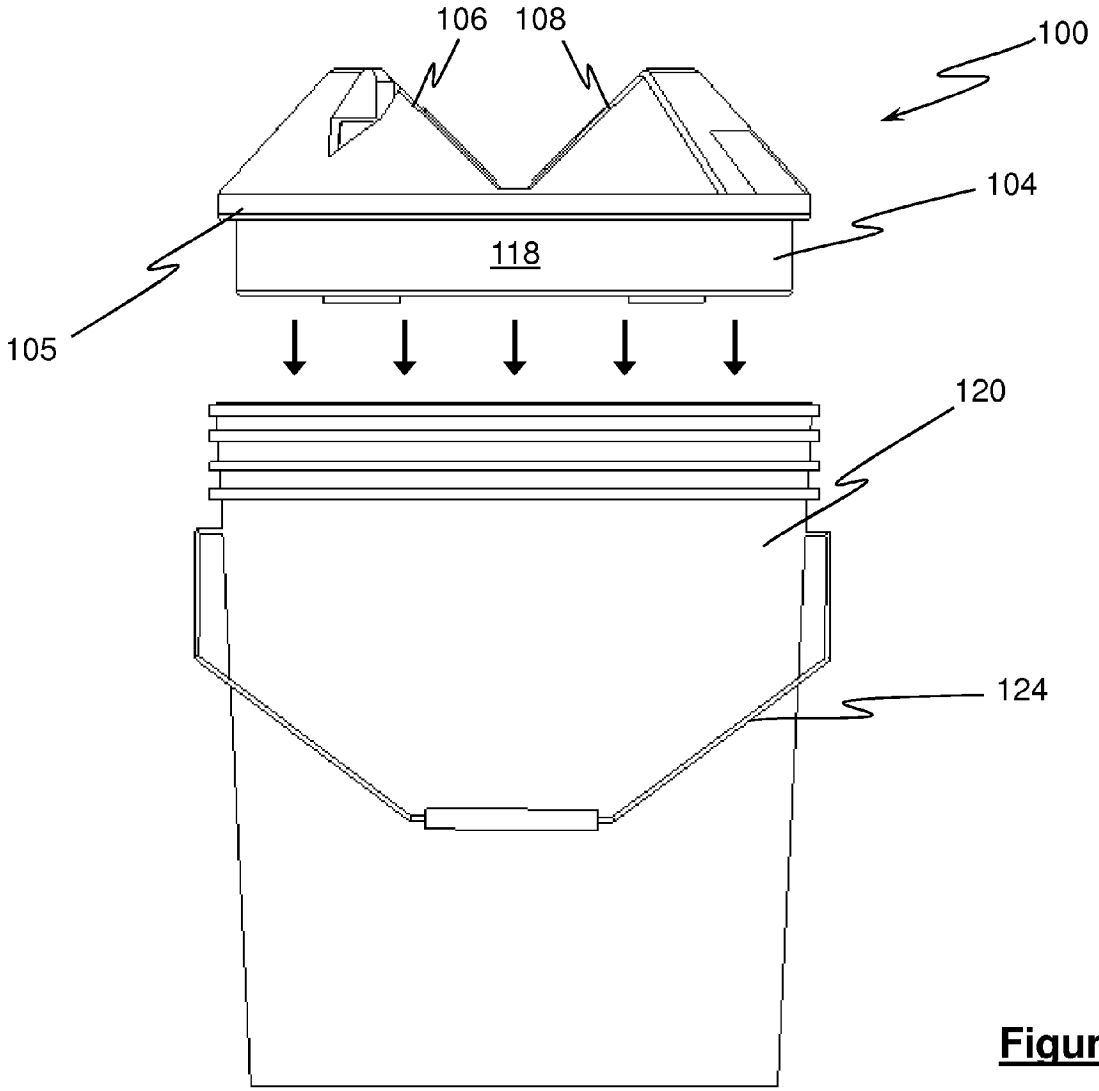
FIG. 20 is a side view of the portable cradle device of FIG. 1 being associated with a utility bucket.
Figure 21:
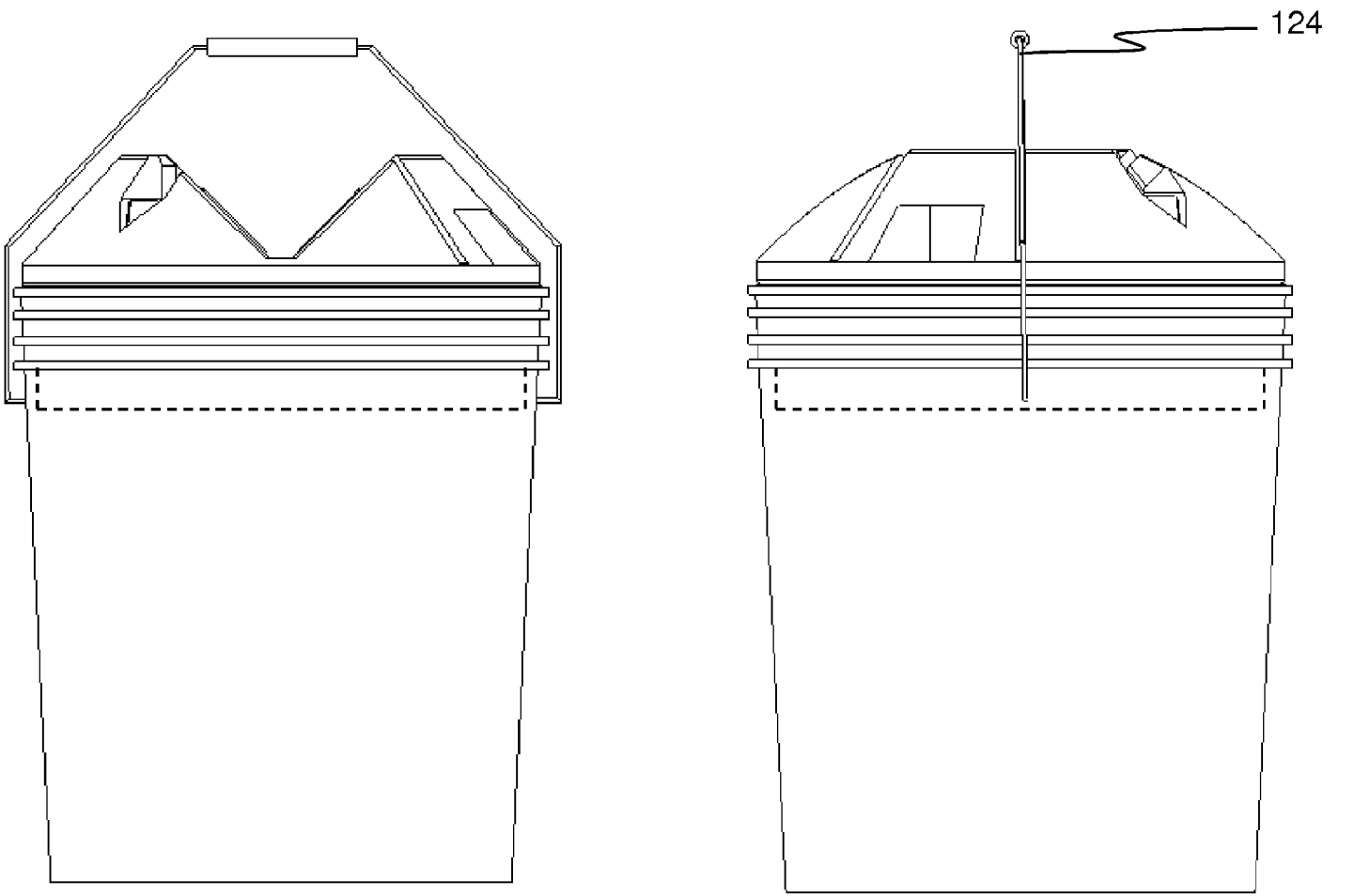
FIG. 21 is a side view of the portable cradle device of FIG. 1 associated with a utility bucket.
Figure 22:
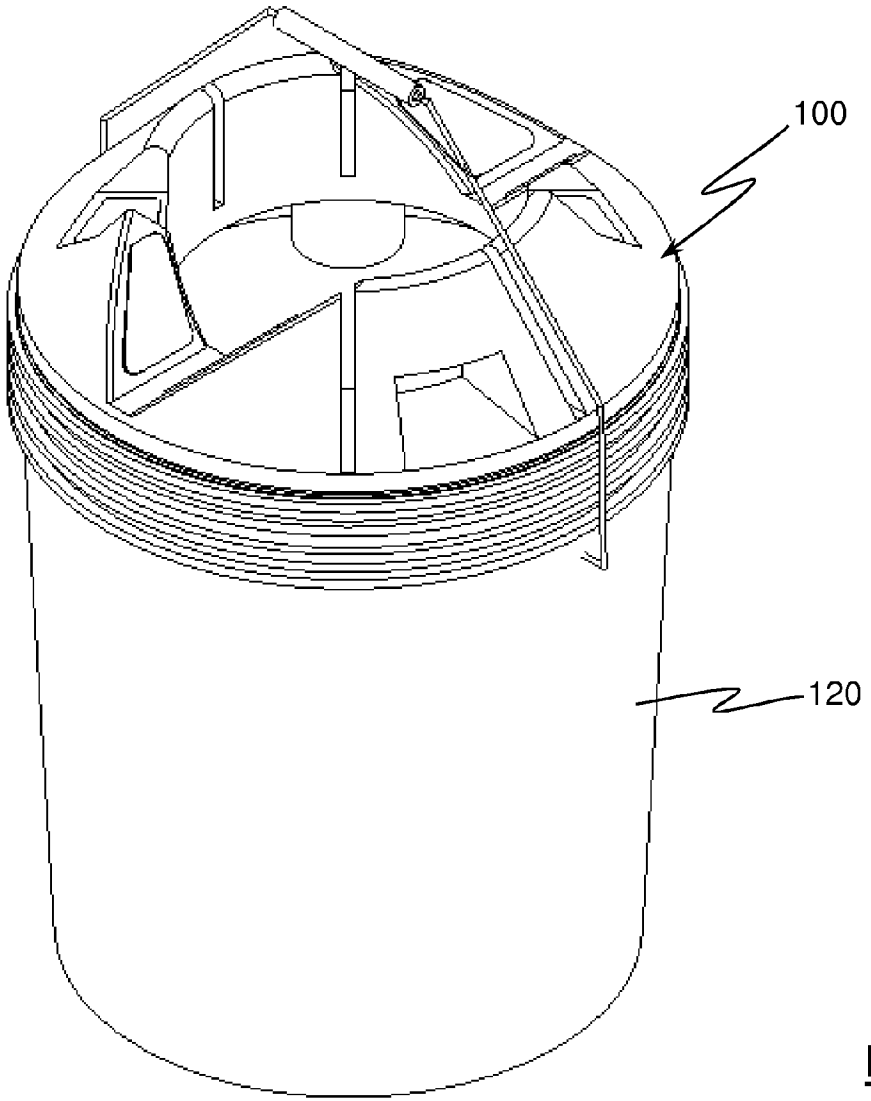
FIG. 22 is an isometric perspective view of the portable cradle device of FIG. 1 associated with a utility bucket.

Referring to FIG. 18 and FIG. 19, as discussed briefly hereinabove, cradle bottom section 104 of portable cradle device 100, 200, 500 includes a cradle support structure 118 extending downward from the cradle top portion 102, where the cradle support structure 118 may be cylindrical in shape and have a diameter c, where diameter c is typically smaller than the diameter d of top portion base structure 105 (although in some cases diameter c could be larger than diameter d). Referring to FIG. 20, FIG. 21 and FIG. 22, the cradle support structure 118 diameter c may be sized to snugly fit inside the cavity of a utility bucket 120 and the diameter d of top portion base structure 105 may be sized such that a portion of the top portion base structure 105 extends past the cradle support structure 118 to form a lip 121 (also see FIG. 4) that rests upon the lip/edge of the utility bucket 120 (or other open ended object). Accordingly, the utility bucket 120 can be used as a support for the portable cradle device 100, 200, 500 while resizing (i.e. cutting) or refitting (i.e. connecting multiple components) a component.

Moreover, the cradle top section 102 may have a geometry that allows the portable cradle device 100, 200, 500 to be associated with the utility bucket 120 without interference from the utility bucket handle 124 regardless of the position of the utility bucket handle 124. Additionally, the portable cradle device 100, 200 may include connection devices (not shown) that allow the portable cradle device 100, 200, 500 to be securingly and firmly associated with the utility bucket 120 via the lip or edge of the utility bucket 120, such as for example, snaps, clips, friction devices, bolts, etc. One embodiment may include a cradle support structure 118 having a diameter c which is sized to frictionally interact with the inside surface of the bucket to frictionally hold the cradle support structure 118 in the bucket. In this case it is conceivable that the cradle support structure 118 is configurable such that the cradle support structure 118 has a diameter c that is resizable to fit larger and/or smaller sized buckets (or other open ended objects). In such case, the circumference or diameter of the cradle support structure 118 could expand or contract as desired. It is also contemplated that top portion base structure 105 may be sizably configurable to accommodate various sized bucket openings. In such case, the circumference/diameter of the top portion base structure 105 could expand or contract as desired to fit larger and/or smaller sized buckets (or other open ended objects).

Accordingly, when associated with the utility bucket 120 the portable cradle device 100, 200, 500 is stably and securely supported. It should be appreciated that the cradle support structure 118 may be hollow in center such that when the cradle support structure 118 is associated with the utility bucket 120, tools and/or components within the utility bucket that are sticking up from the bucket cavity can be located within the hollow portion of the cradle support structure 118. Thus, the portable cradle device 100, 200, 500 may be used with the utility bucket 120 even when the utility bucket 120 includes tools and/or components. Referring again to FIG. 4 and FIG. 18, it is contemplated that the cradle support structure 118 which may include a plurality of feet 122 having traction pads 122 (and/or bosses) which may be used to support the portable cradle device 100, 200, 500 on a flat surface, such as for example a work bench, a floor or a table top, rather than a bucket. It is further contemplated that the feet 122 may be hollow and configured to receive (and securely contain) separate legs or the hollow portion of the feet 122 may include a leg member that telescopes (or rotates out) into supporting legs so that the portable cradle device 100, 200, 500 may be a 'free standing' device. As such, the leg members are configurable between a retracted configuration (for storage or low profile) and an extended configuration (for support above a supporting surface). Moreover, it should be appreciated that the overall size of the portable cradle device 100, 200, 500 allows for the portability of the portable cradle device 100, 200, 500.

Additionally, it is contemplated that the cradle bottom section 104 may be configured such that cradle support structure 118 is hollow to allow component shavings generated by cutting the component 112 to fall directly into the utility bucket. Or the cradle bottom section 104 may be configured such that cradle support structure 118 includes a closed bottom having a small hollow area to allow component shavings generated by cutting the component 112 to fall directly into the small hollow area. To discard the shavings, simply dump the contents of the small hollow area into a waste bin. Either way, these features allow for easy clean up. It is further contemplated that a component securing device (not shown) may be included to help secure and stabilize the article 112, 115 in the portable cradle device 100, 200, 500 while being cut or reconfigured.

It should be appreciated that the portable cradle device 100, 200, 500 may be securely associated with the utility bucket 120 via a snug (friction) fit of the cradle support structure 118 with the inside walls of the utility bucket 120 or via another type of mechanical device and/or method, such as a clip, snap or Velcro®.

Figure 23:
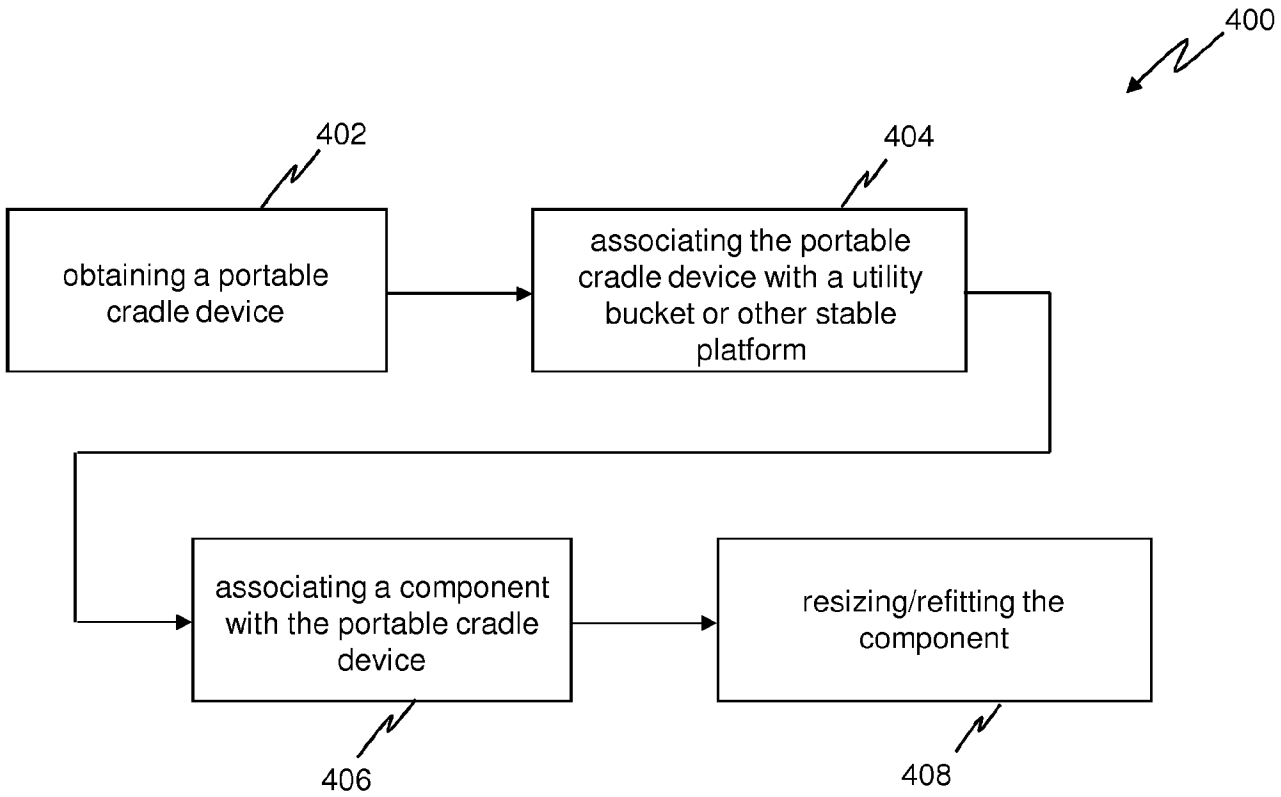
FIG. 23 is a block diagram illustrating a method for implementing the portable cradle device of FIG. 1 and FIG. 9.
Figure 24A:
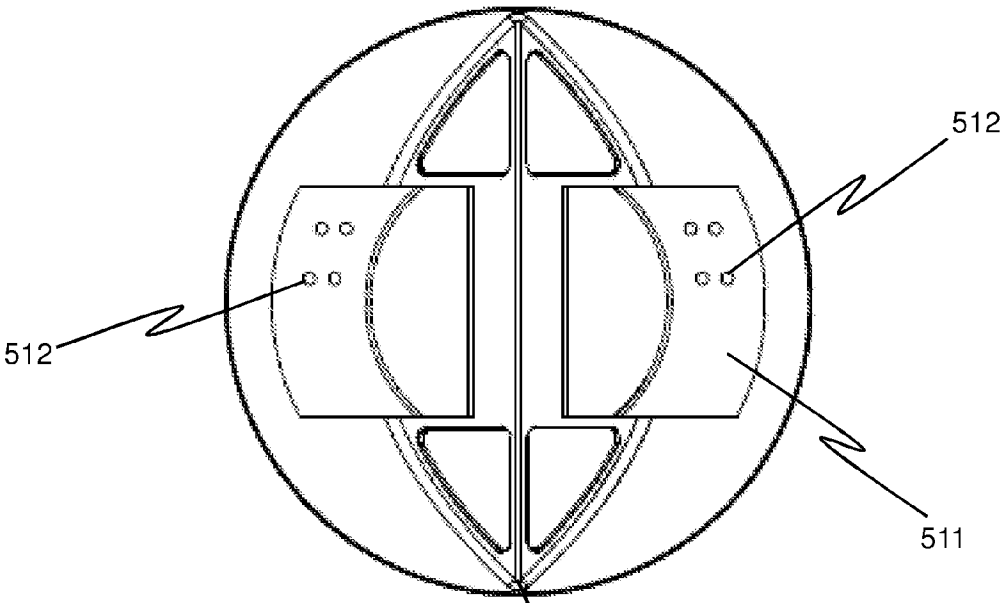
FIG. 24A is a top down view of another embodiment of the portable cradle device, in accordance with the invention.
Figure 24B:
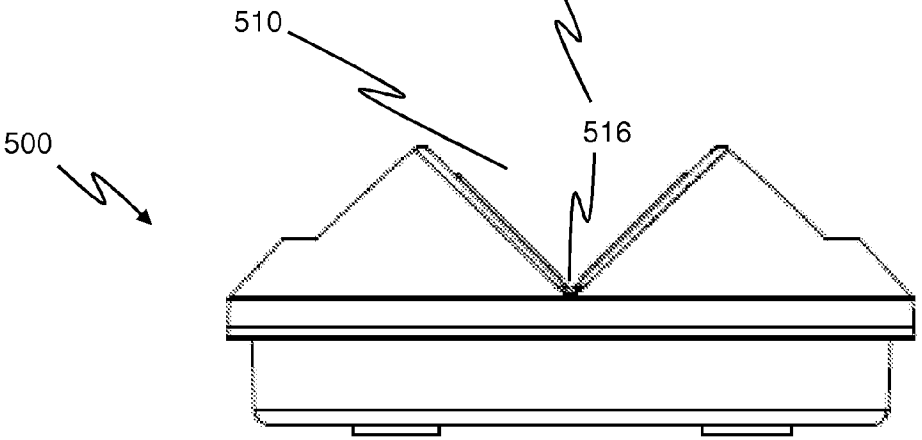
FIG. 24B is a side view of the portable cradle device of FIG. 24A.
Figure 25A:
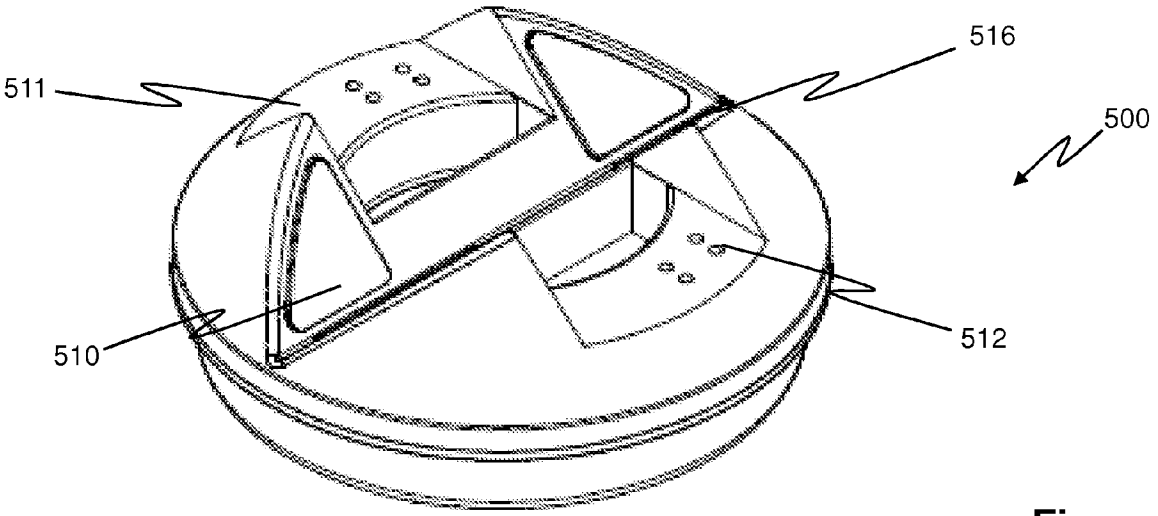
FIG. 25A is an isometric view of the portable cradle device of FIG. 24A.
Figure 25B:
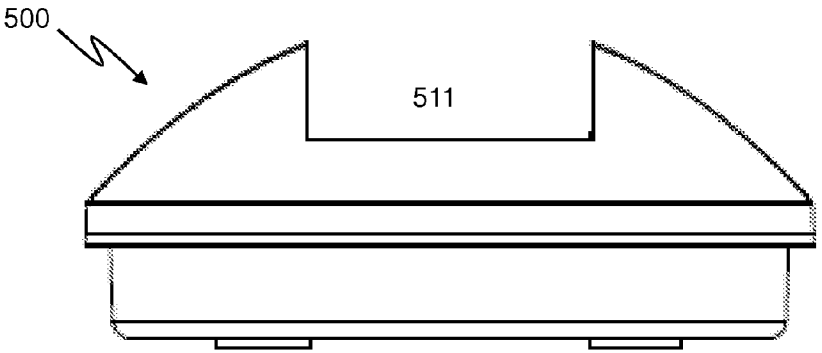
FIG. 25B is a side view of the portable cradle device of FIG. 24A.
Figure 26A:
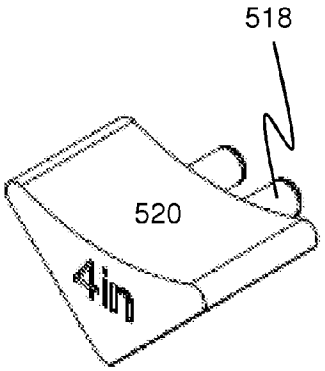
FIG. 26A is an isometric view of another embodiment of a valley resizing device, in accordance with the invention.
Figure 26B:
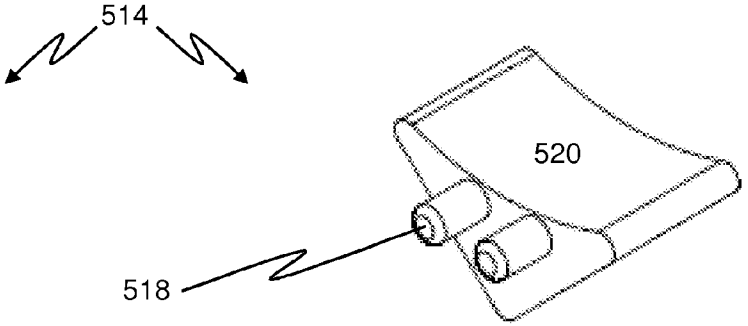
FIG. 26B is an isometric view of the valley resizing device of FIG. 26A.
Figure 26C:
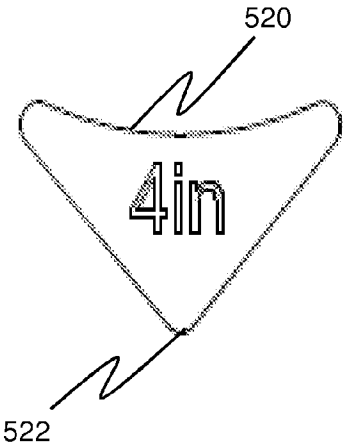
FIG. 26C is a front view of the valley resizing device of FIG. 26A.
Figure 26D:
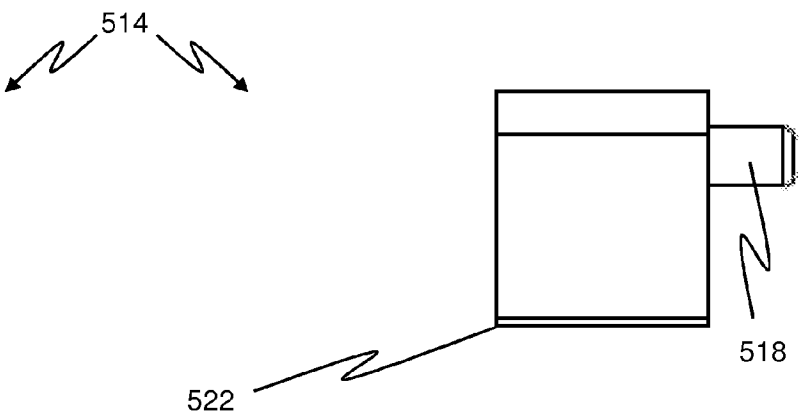
FIG. 26D is a side view of the valley resizing device of FIG. 26A.

Referring to FIG. 23, a block diagram illustrating a method 400 for implementing the portable cradle device 100, 200, 500 is shown and includes obtaining a portable cradle device 100, 200, 500 and a utility bucket 120, as shown in operational block 402 and associating the portable cradle device 100, 200, 500 with the utility bucket 120 (or some other stable platform, such as a bench, table or floor), as shown in operational block 404. As discussed above, one way this may be accomplished is by positioning the cradle support structure 118 of the portable cradle device 100, 200, 500 within the cavity of the utility bucket 120 to be snugly and frictionally associated with the inside walls of the utility bucket 120. A component 112, 115 to be cut or reconfigured is then placed within valley 110, 210 to be supported by first component support structure 106 and second component support structure 108, as shown in operational block 406. The component 112, 115 can then be resized, refitted or reconfigured by stabilizing the component 112, 115 by hand or by using a component securing device (if included), as shown in operational block 408. If the user desires to cut the component 112, 115 by using a cutting guide 216 (if included) then the user will cut along the path provided by the cutting guide 216. However, if the user desires to cut the component 112, 115 without using a cutting guide 216 then the user can cut the component 112, 115 as it extends out of cavity 110, 210.

Figure 27:
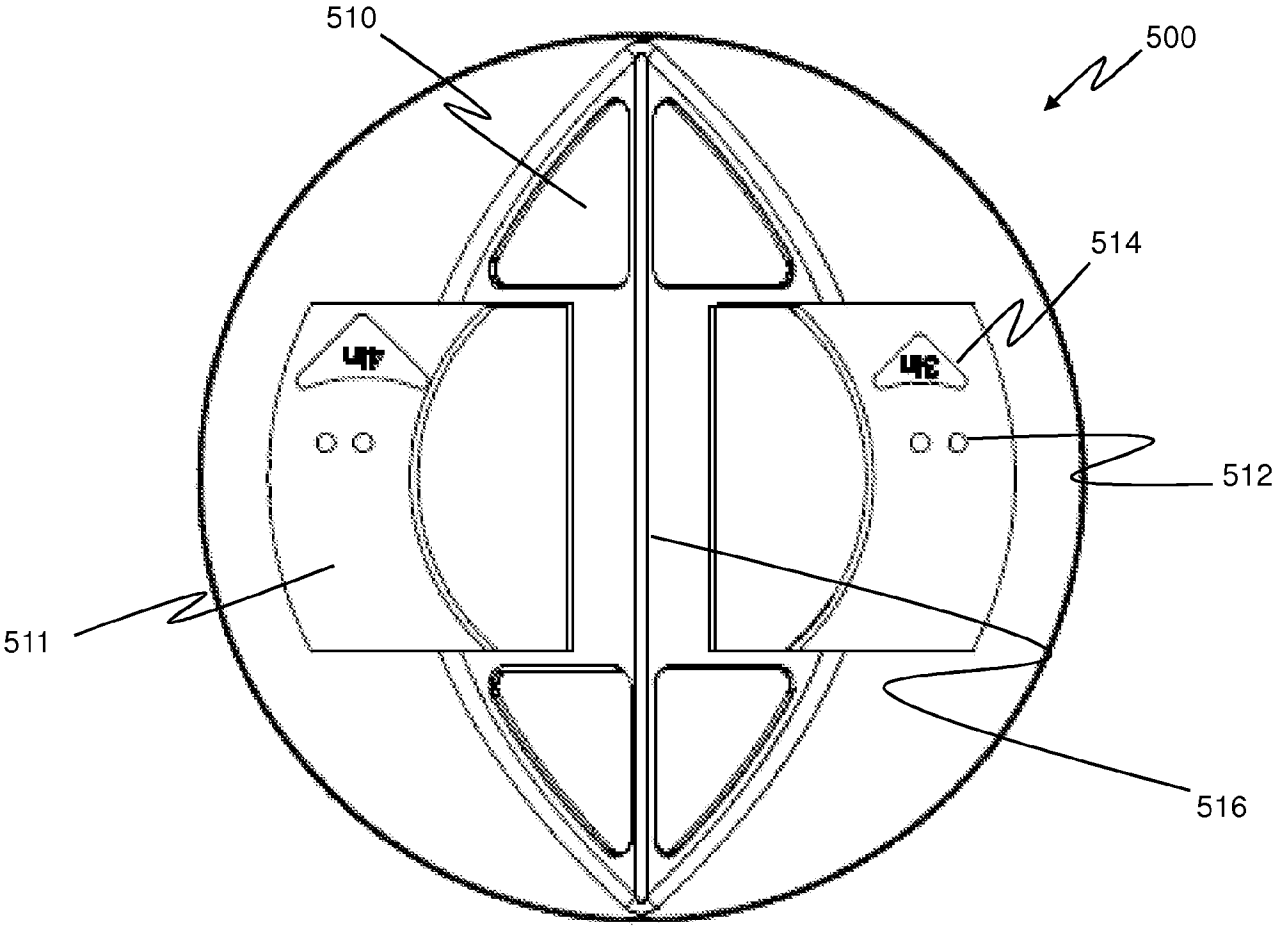
FIG. 27 is a top down view of the portable cradle device of FIG. 24A including the valley resizing device of FIG. 26A.
Figure 28:
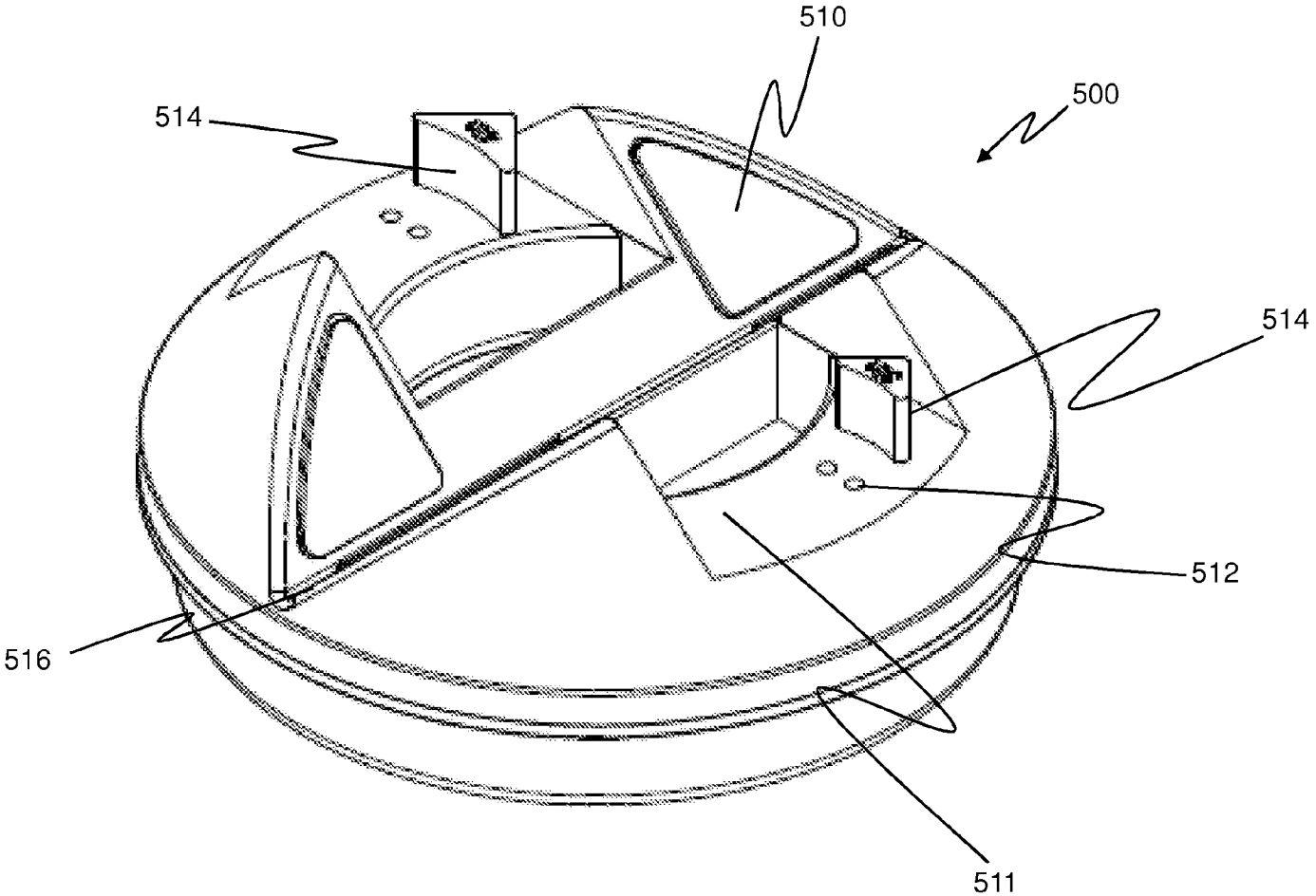
FIG. 28 is an isometric view of the portable cradle device of FIG. 24A including the valley resizing device of FIG. 26A.
Figure 29:
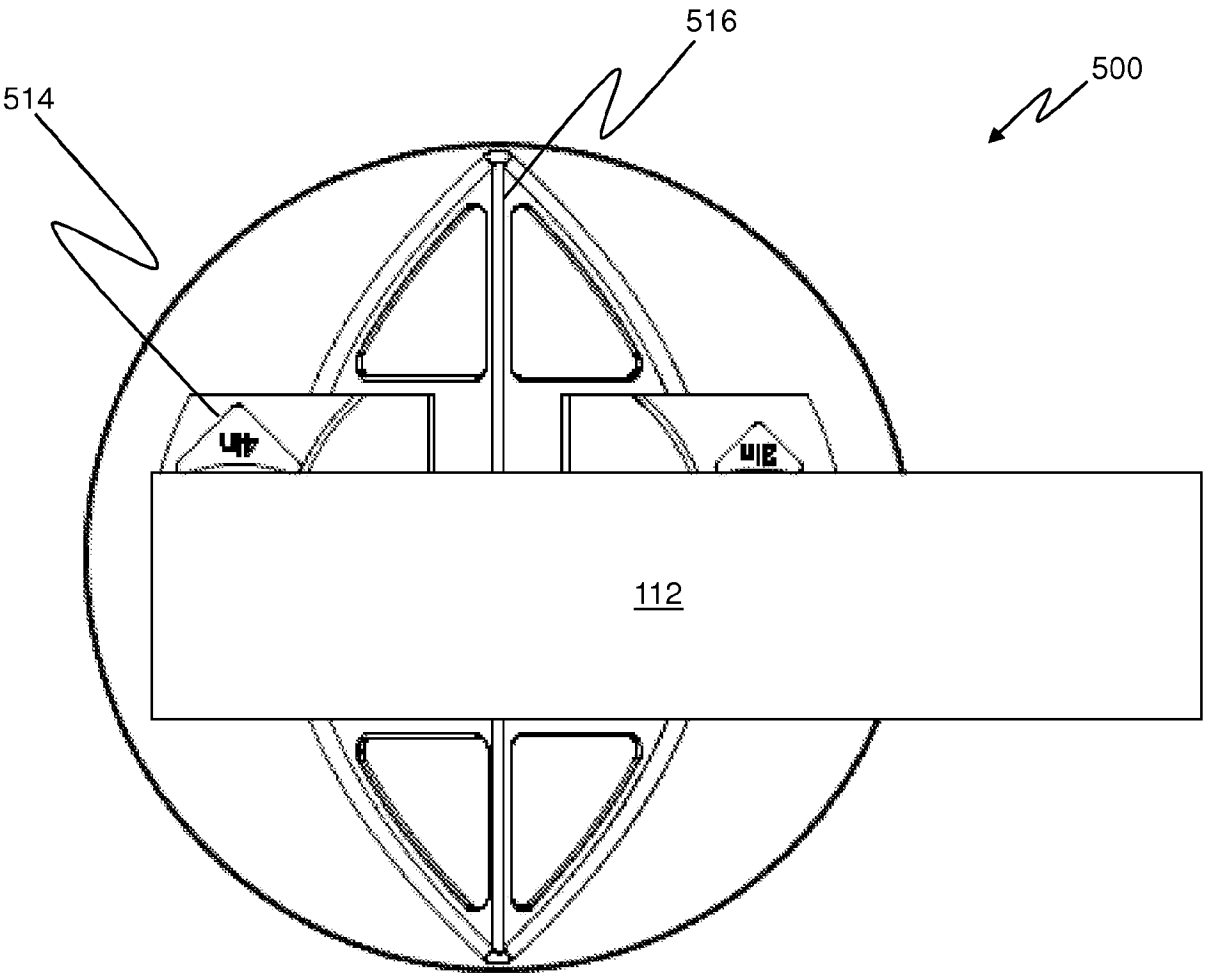
FIG. 29 is a top down view of the portable cradle device of FIG. 24A containing a component to be cut, where the portable cradle device includes the valley resizing device of FIG. 26A to resize the valley for containing the component to be cut.
Figure 30:
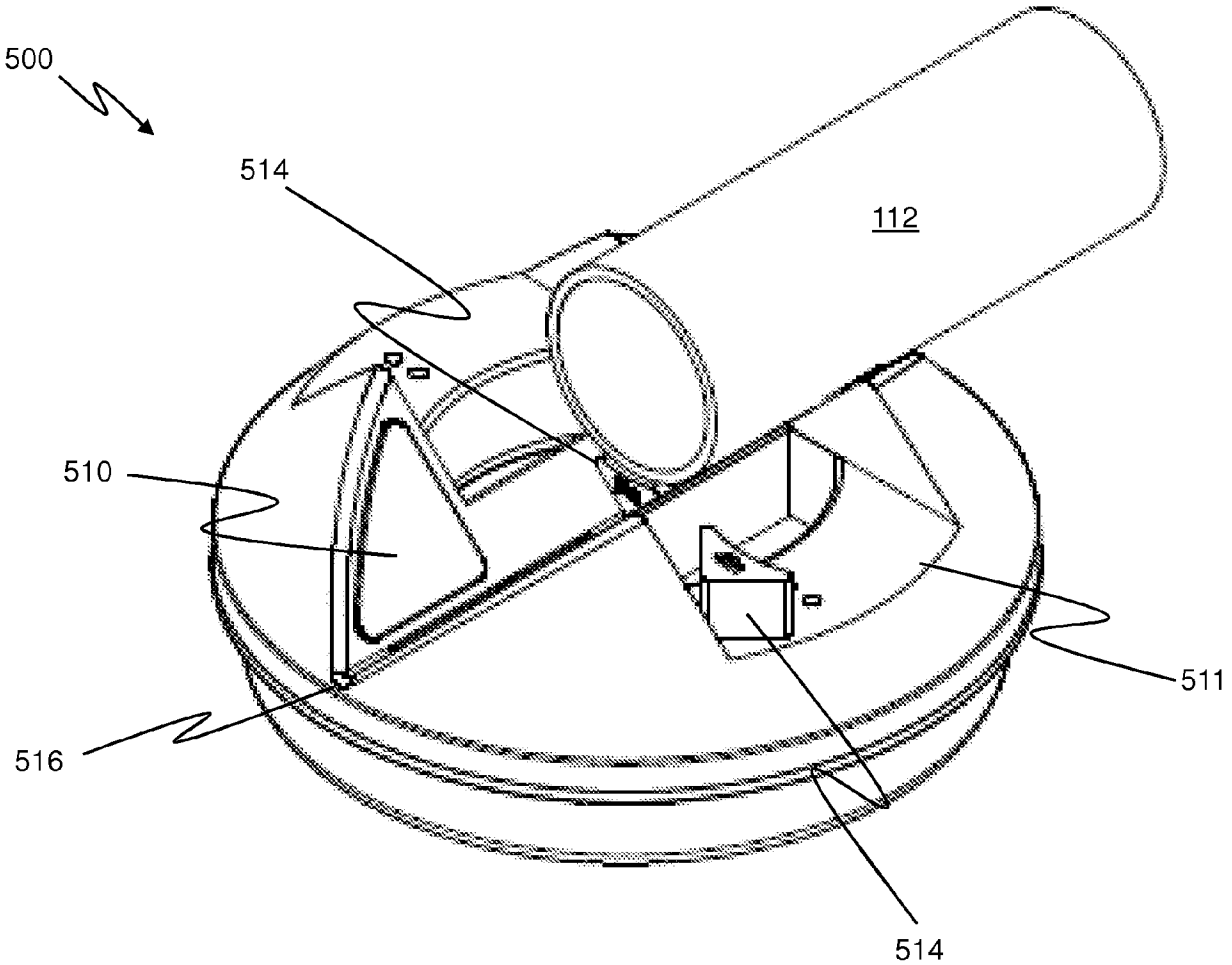
FIG. 30 is an isometric view of the portable cradle device of FIG. 24A containing a component to be cut, where the portable cradle device includes the valley resizing device of FIG. 26A to support the component to be cut.

Referring to FIGS. 24-29, still yet another embodiment of the portable cradle device 500 is shown and is configured to include valleys 510, 511 that are rectangular, triangular square and/or substantially curved in shape to function with different types of components 112 (such as pipes, boards, etc) having different sizes and shapes (such as components 112 that are rectangular, round or square), to allow variously shaped components 112 to be cut. It is contemplated that valleys 511 may include at least one hole 512 configured to interface with valley resizing devices 514 to allow different sized articles to be securely supported while being cut using the portable cradle device 500. Additionally, portable cradle device 500 may also includes a cradle support valley 516 to contain one or more valley resizing devices 514 (of varying sizes) for supporting (if necessary) a pipe 112 during cutting, connecting, etc. Accordingly, resizing device 514 may be used to resize the valley 511 to adjust for various component 112 sizes (as shown in FIGS. 27-29) and resizing device 514 may be used to support a component 112 (when resizing device 514 is associated with cradle support valley 516) when the component 112 is located in valley 510 (as shown in FIG. 30), as discussed further herein.

Referring to FIGS. 26A-26D, another embodiment of a resizing device 514 is shown and includes at least one protruding member 518 for associating with the portable cradle device 500 via the at least one hole 512. The resizing device 514 may also include at least one support surface 520 that is substantially curved in shaped to support a pipe when being cut and/or a substantially rounded and/or pointed surface 522 configured such that the substantially rounded and/or pointed surface 522 can be contained within the cradle support valley 516. This is shown in FIG. 30, where a pipe is located in a valley 510 for cutting and the substantially rounded and/or pointed surface 522 of a resizing device 514 is located in the cradle support valley 516 such that the pipe is supported by support surface 520 (of resizing device 514).

As shown in FIGS. 27-29, the resizing device 514 may also be configured to be associated with the portable cradle device 500 by locating the protruding member 518 in the at least one hole 512 to resize the valley 511 for containing a board (or other object) 112 to be cut. It should be appreciated that in order to accommodate larger or smaller components 112 to be cut, the protruding member 518 of the resizing device 514 may be located in other holes 512 within the valley 511 and/or smaller/larger sized resizing devices 514 may be used. It should be appreciated that other shaped resizing devices may be used or the resizing device 514 may include other shaped surfaces as desired to support or associate with a component 112 to be cut. It should be further appreciated that although the portable cradle device 100, 200, 500 are shown herein as being substantially round in shape, the portable cradle device 100, 200, 500 (or portions thereof) may also be configured in other shapes to be used with various sized buckets or other open ended objects (such as boxes, etc.)

It should be appreciated that the portable cradle device 100, 200, 500 may be constructed from any material or combination of materials suitable to the desired end purpose, such as plastic, ceramic, metal and/or wood. It should also be appreciated that any of the elements and/or configurations of the embodiments may be combined and used with any other of the other embodiments as desired. For example, the resizing device shown in FIGS. 11-13 may be used with the portable cradle device 500 and vice versa. Moreover, while the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A portable cradle device, comprising:

a cradle top section and a cradle bottom section, wherein the cradle top section includes a top portion base structure having a first component support structure and a second component support structure, where the first component support structure and the second component support structure are separated by a component support valley, and the cradle bottom section includes a cradle support structure extending downward from the top portion base structure, wherein the cradle support structure is sized and shaped to associate with the opening of and be partially contained within the cavity of a utility bucket, and wherein the cradle support structure and the top portion base structure are sized relative to each other such that the top portion base structure extends over the cradle support structure to form a lip such that when the portable cradle device is associated with the utility bucket, the cradle support structure is located within the cavity of the utility bucket and the top portion base structure lip rests on the edge of the utility bucket cavity; and at least one saw guide, wherein the at least one saw guide is at least one of, positioned at an angle of 45° relative to the component support valley, positioned at an angle of 90° relative to the component support valley, and configurable between a 1° angle and a 90° angle, relative to the component support valley.

2. The portable cradle device of claim 1, wherein the first component support structure and the second component support structure each include a component surface that is angled from the vertical to form the component support valley.

3. The portable cradle device of claim 2, wherein the component support valley is substantially "V" shaped.

4. The portable cradle device of claim 2, wherein at least one component surface includes a traction structure configured to limit movement of a component.

5. The portable cradle device of claim 1, further comprising at least one handle.

6. The portable cradle device of claim 1, further comprising a second component support valley having a traction structure configured to limit movement of a component.

7. The portable cradle device of claim 1, further comprising a plurality of feet.

8. The portable cradle device of claim 7, wherein each of the plurality of feet includes a hollow portion configured to securely contain a leg member.

9. The portable cradle device of claim 7, wherein each of the plurality of feet include a hollow portion having at least one of, a telescoping leg member; and a rotatable leg member.

10. The portable cradle device of claim 1, further comprising at least one valley resizing device, wherein the at least one valley resizing device and the portable cradle device are configured to associate with each to resize the component support valley.

11. The portable cradle device of claim 10, wherein the component support valley includes at least one insert hole and the at least one valley resizing device includes at least one protruding member, such that when the valley resizing device is associated with the at least one insert hole, the protruding member is located within the insert hole.

12. A portable cradle device, comprising:

a cradle top section and a cradle bottom section, wherein the cradle top section includes a top portion base structure having a first component support structure and a second component support structure, where the first component support structure and the second component support structure are separated by a component support valley, and the cradle bottom section includes a cradle support structure extending downward from the cradle top portion, wherein the cradle support structure is sized and shaped to fit within the cavity of a utility bucket, wherein a portion of the cradle top section is sized relative to the cradle bottom section to form a cradle lip such that when the portable cradle device is associated with the utility bucket, the cradle lip rests on the edge of the utility bucket cavity; and at least one saw guide, wherein the at least one saw guide is positioned at an angle ranging between 1° and 90° relative to the component support valley.

13. The portable cradle device of claim 12, wherein the first component support structure and the second component support structure each include a component surface that is angled from the vertical to form the component support valley.

14. The portable cradle device of claim 12, wherein the component support valley is substantially "V" shaped.

15. The portable cradle device of claim 12, further comprising a plurality of feet.

* * * * *